US006630796B2

(12) United States Patent
Tokunaga et al.

(10) Patent No.: US 6,630,796 B2
(45) Date of Patent: Oct. 7, 2003

(54) METHOD AND APPARATUS FOR DRIVING A PLASMA DISPLAY PANEL

(75) Inventors: Tsutomu Tokunaga, Yamanashi (JP); Mitsushi Kitagawa, Fukuroi (JP); Hideto Nakamura, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 0 days.

(21) Appl. No.: 10/153,809

(22) Filed: May 24, 2002

(65) Prior Publication Data

US 2002/0195963 A1 Dec. 26, 2002

(30) Foreign Application Priority Data

May 29, 2001 (JP) ..... 2001-160542
Jun. 27, 2001 (JP) ..... 2001-194800

(51) Int. Cl.[7] ..... G09G 3/10

(52) U.S. Cl. ..... 315/169.4; 315/169.1; 345/67; 345/68

(58) Field of Search ..... 315/169.1, 169.3, 315/169.4, 169.2; 345/41, 42, 48, 55, 60, 66, 67, 68

(56) References Cited

U.S. PATENT DOCUMENTS 6,175,194 B1 * 1/2001 Saegusa et al. ..... 315/169.4
6,304,038 B1 * 10/2001 Ide et al. ..... 315/169.1
6,465,970 B2 * 10/2002 Nagakubo et al. ..... 315/169.4
6,472,825 B2 * 10/2002 Shigeta et al. ..... 315/169.4
6,479,943 B2 * 11/2002 Shigeta et al. ..... 315/169.4

* cited by examiner

*Primary Examiner*—Hoang Nguyen
(74) *Attorney, Agent, or Firm*—Sughrue Mion, PLLC

(57) ABSTRACT

A driving apparatus of a plasma display panel performs allows image display in a desired way. When discharge cells are driven to repetitively execute a sustain-discharge by the application of sustaining pulses to row electrodes the number of times corresponding to subfields, a ratio of changes of a voltage value in a trailing interval of the last sustaining pulse among those sustaining pulses is set to be milder than that of a voltage value in a trailing interval of the sustaining pulse which is applied just before the last sustaining pulse. Further, description has been made for a driving method of a plasma display panel which can perform an image display of high quality by performing a proper selective discharge while preventing an erroneous discharge of the discharge cells in a pixel data writing step. A trailing edge portion of the sustaining pulse which is applied finally among the sustaining pulses applied in a light emission sustaining step has an undershoot part below a ground potential.

36 Claims, 19 Drawing Sheets

FIG. 2

| DATA CONVERSION TABLE | | | | | | | | | | | | | | | 1 FIELD LIGHT EMISSION DRIVING PATTERN | | | | | | | | | | | | | | LUMINANCE |
|---|---|---|---|---|---|---|---|---|---|---|---|---|---|---|---|---|---|---|---|---|---|---|---|---|---|---|---|---|---|
| PD | GD | | | | | | | | | | | | | | SF | SF | SF | SF | SF | SF | SF | SF | SF | SF | SF | SF | SF | SF | |
| | 1 | 2 | 3 | 4 | 5 | 6 | 7 | 8 | 9 | 10 | 11 | 12 | 13 | 14 | 1 | 2 | 3 | 4 | 5 | 6 | 7 | 8 | 9 | 10 | 11 | 12 | 13 | 14 | |
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

●: SELECTIVE ERASURE DISCHARGE
○: LIGHT EMISSION

FIG. 16

| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| 1ST MODE | 4 | 12 | 20 | 32 | 40 | 52 | 64 | 76 | 88 | 100 | 112 | 128 | 140 | 156 |
| 2ND MODE | 3 | 9 | 15 | 24 | 30 | 39 | 48 | 57 | 66 | 75 | 84 | 96 | 105 | 117 |

FIG. 18

(SELECTIVE ERASURE)

| GRADATION | SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE | |
|---|---|---|---|---|---|---|---|---|---|---|---|---|---|---|---|---|
| | | | | | | | | | | | | | | | 1ST MODE | 2ND MODE |
| 1 | ● | | | | | | | | | | | | | | 0 | 0 |
| 2 | ○ | ● | | | | | | | | | | | | | 4 | 3 |
| 3 | ○ | ○ | ● | | | | | | | | | | | | 16 | 12 |
| 4 | ○ | ○ | ○ | ● | | | | | | | | | | | 36 | 27 |
| 5 | ○ | ○ | ○ | ○ | ● | | | | | | | | | | 68 | 51 |
| 6 | ○ | ○ | ○ | ○ | ○ | ● | | | | | | | | | 108 | 81 |
| 7 | ○ | ○ | ○ | ○ | ○ | ○ | ● | | | | | | | | 160 | 120 |
| 8 | ○ | ○ | ○ | ○ | ○ | ○ | ○ | ● | | | | | | | 224 | 168 |
| 9 | ○ | ○ | ○ | ○ | ○ | ○ | ○ | ○ | ● | | | | | | 300 | 225 |
| 10 | ○ | ○ | ○ | ○ | ○ | ○ | ○ | ○ | ○ | ● | | | | | 388 | 291 |
| 11 | ○ | ○ | ○ | ○ | ○ | ○ | ○ | ○ | ○ | ○ | ● | | | | 488 | 366 |
| 12 | ○ | ○ | ○ | ○ | ○ | ○ | ○ | ○ | ○ | ○ | ○ | ● | | | 600 | 450 |
| 13 | ○ | ○ | ○ | ○ | ○ | ○ | ○ | ○ | ○ | ○ | ○ | ○ | ● | | 728 | 546 |
| 14 | ○ | ○ | ○ | ○ | ○ | ○ | ○ | ○ | ○ | ○ | ○ | ○ | ○ | ● | 868 | 651 |
| 15 | ○ | ○ | ○ | ○ | ○ | ○ | ○ | ○ | ○ | ○ | ○ | ○ | ○ | ○ | 1024 | 768 |

●: SELECTIVE ERASURE DISCHARGE
○: LIGHT EMISSION

METHOD AND APPARATUS FOR DRIVING A PLASMA DISPLAY PANEL

BACKGROUND OF THE INVENTION

1. Field of the Invention

The invention relates to method and apparatus for driving a plasma display panel of a matrix display system.

2. Description of Related Art

AC discharge type plasma display panel is known as one of the plasma display panels (hereinafter, referred to as PDP) of the matrix display system.

The PDP of the AC discharge type has a plurality of column electrodes, and a plurality of row electrode pairs arranged via a discharge space filled with a discharge gas so as to cross each of the column electrodes. A discharge cell which emits light in red color, a discharge cell which emits light in green color, or a discharge cell which emits light in blue color is formed at each of intersecting positions of the row electrode pairs and the column electrodes embracing the discharge space, respectively.

Since each discharge cell performs the light emission by using a discharge phenomenon, it has only two states, "light-on state" in which the light is emitted at predetermined luminance and "light-off state". That is, only the luminance of two gradations can be expressed. To realize a halftone luminance display corresponding to a supplied video signal by using the discharge cells, a gradation driving using a subfield method is performed.

According to the subfield method, a display period of time of one field is divided into N subfields, and a period of time during which the discharge cell is to be driven to continuously emit light (or turn off) is preliminarily allocated to each subfield. Each discharge cell is allowed to perform the light emission (or light-off) for each subfield in response to the input video signal only during the period of time allocated to the subfield. By a combination of the subfields for executing the light emission during one field display period of time, various halftone luminance at $2^N$ (N:the number of subfields) stages (hereinafter, referred to as gradations) can be expressed.

When executing the gradation driving based on the subfield method, a driving apparatus (not shown) applies various driving pulses to the PDP, thereby causing various discharges in the discharge cells, respectively. That is, first, the driving apparatus applies reset pulses to the row electrode pairs of the PDP, thereby causing a reset discharge in all of the discharge cells. In this case, a predetermined amount of wall charges are uniformly formed in all of the discharge cells by the reset discharge. Subsequently, the driving apparatus sequentially allows the discharge cells to selectively perform an erasure discharge for each horizontal scanning line (hereinafter, referred to as one display line) in accordance with the input video signal. In this process, in the discharge cell in which the selective erasure discharge has been caused, the wall charges remaining in the discharge cell are extinguished, and the discharge cell is set to a "light-off discharge cell". In the discharge cell in which the selective erasure discharge is not caused, since the wall charges formed by the reset discharge remain as they are, the discharge cell is set to a "light-on discharge cell". Subsequently, the driving apparatus alternately applies sustaining pulses in a lump to all of the row electrode pairs the number of times corresponding to the subfields. In accordance with the application of the sustaining pulses, the discharge cells in which the wall charges remain, that is, only the discharge cells set to the "light-on discharge cells" repetitively perform a sustain discharge only during the period of time corresponding to the subfields and maintain the light emitting state associated by the sustain discharge. In the discharge cells set to the "light-off discharge cells", a discharge is not caused, but the light-off state is maintained only during the period of time corresponding to the subfields.

In the PDP, however, since amounts of wall charges formed by the various discharges as mentioned above are not constant due to a temperature fluctuation of the panel, changes of the display luminance, time change, or the like, there is a problem that a variation occurs in intensity of the discharge and display quality deteriorates.

In a display apparatus using the subfield method, when a voltage of a scanning pulse is raised, an electric potential difference increases between the column electrodes and the row electrodes. In a pixel data writing step, the selective discharge easily occurs in the discharge cell which should become the light emitting cell by the application of a pixel data pulse of a low voltage. There is, however, a possibility that an erroneous discharge occurs in the discharge cell which should become the non-light emitting cell by the application of a pixel data pulse of a high voltage.

When the voltage of the scanning pulse is reduced, since the potential difference between the column electrodes and the row electrodes decreases, in the pixel data writing step, erroneous discharge does not occur in the discharge cell which should become the non-light emitting cell by the application of the pixel data pulse of the high voltage. However, the selective discharge becomes hard to occur in the discharge cell to which the pixel data pulse of the low voltage is applied.

OBJECTS AND SUMMARY OF THE INVENTION

The invention is made to solve the above problems and it is an object of the invention to provide a driving method of a plasma display panel which can always perform a image display in a preferable way.

It is, therefore, another object of the invention to provide a driving method of a plasma display panel which can perform a high quality image display by executing a proper selective discharge while preventing an erroneous discharge in a discharge cell in a pixel data writing step.

According to one aspect of the invention, there is provided a driving apparatus of a plasma display panel which has a plurality of row electrode pairs corresponding to display lines and a plurality of column electrodes arranged so as to cross each of the row electrode pairs and in which a discharge cell serving as a pixel is formed in each intersecting portion of the row electrode pairs and the column electrodes and which is driven every plural subfields constructing one field display period of time of a video signal, comprising: a resetting part for repetitively applying reset pulses to all of the row electrode pairs in at least one of the subfields and allowing all of the discharge cells to repetitively execute a reset-discharge, thereby initializing each of the discharge cells into either a light-on discharge cell state or a light-off discharge cell state; an addressing part for applying scanning pulses to one of each of the row electrode pairs in each of the subfields and applying pixel data pulses corresponding to the video signal to the column electrodes, thereby allowing each of the discharge cells to selectively discharge, and setting the discharge cells to either the light-on discharge cell state or the light-off discharge cell state; and a light emission sustaining part for applying sustaining pulses to each of the row electrode pairs in each of the subfields the number of times corresponding to the subfields, thereby allowing only the discharge cells in the light-on discharge cell state to repetitively execute a sustain-discharge, wherein a change rate of a voltage value in a trailing interval of the last sustaining pulse among the sustaining pulses is milder than that of a voltage value in a trailing interval of at least the sustaining pulse just before the last sustaining pulse.

According to another aspect of the invention, there is provided a driving apparatus of a plasma display panel which has a plurality of row electrode pairs corresponding to display lines and a plurality of column electrodes arranged so as to cross each of the row electrode pairs and in which a discharge cell serving as a pixel is formed in each intersecting portion of the row electrode pairs and the column electrodes and which is driven every plural subfields constructing one field display- period of time of a video signal, comprising: a resetting part for repetitively applying reset pulses to all of the row electrode pairs in at least one of the subfields and allowing all of the discharge cells to repetitively reset-discharge, thereby initializing each of the discharge cells into either a light-on discharge cell state or a light-off discharge cell state; an addressing part for applying scanning pulses to one of each of the row electrode pairs in each of the subfields and applying pixel data pulses corresponding to the video signal to the column electrodes, thereby allowing each of the discharge cells to selectively discharge, and setting the discharge cells to either the light-on discharge cell state or the light-off discharge cell state; and a light emission sustaining part for applying sustaining pulses to each of the row electrode pairs in each of the subfields the number of times corresponding to the subfields, thereby allowing only the discharge cells in the light-on discharge cell state to repetitively execute a sustain-discharge, wherein a change rate of a voltage value in a trailing interval of the last reset pulse among the reset pulses is milder than that of a voltage value in a trailing interval of at least the reset pulse just before the last reset pulse.

According to still another aspect of the invention, there is provided a driving method for a gradation driving of a plasma display panel in accordance with a video signal, the plasma display panel having a plurality of row electrode pairs having a capacitive load between the pairs and a plurality of column electrodes which are arranged so as to cross the row electrode pairs and form a discharge cell in each intersecting portion, wherein a display period of one field in the video signal is made up of a plurality of subfields, in each of the subfields, executed are: a pixel data writing step of forming pixel data indicative of either a light emitting cell or a non-light emitting cell with respect to each of the discharge cells of the plasma display panel in correspondence to the video signal, sequentially applying scanning pulses to one of each of the row electrode pairs, and applying pixel data pulses corresponding to the pixel data to the column electrodes synchronously with the scanning pulses, thereby setting each of the discharge cells into a state of either the light emitting cell or the non-light emitting cell; and a light emission sustaining step of alternately applying sustaining pulses to the plurality of row electrode pairs the number of times corresponding to a weight of each of the subfields so as to allow only the discharge cells which have been set into the state of the light emitting cell in the pixel data writing step to effect a sustain-discharge, and a trailing edge portion of the sustaining pulse which is applied finally among the sustaining pulses which are applied in the light emission sustaining step has an undershoot part below a ground potential.

According to a further aspect of the invention, there is provided a driving method for a gradation driving of a plasma display panel in accordance with a video signal, the plasma display panel having a plurality of row electrode pairs having a capacitive load between the pairs and a plurality of column electrodes which are arranged so as to cross the row electrode pairs and form a discharge cell in each intersecting portion, wherein a display period of one field in the video signal is made up of a plurality of subfields, in each of the subfields, executed are: a pixel data writing step of forming pixel data indicative of either a light emitting cell or a non-light emitting cell with respect to each of the discharge cells of the plasma display panel in correspondence to the video signal, sequentially applying scanning pulses to one of each of the row electrode pairs, and applying pixel data pulses corresponding to the pixel data to the column electrodes synchronously with the scanning pulses, thereby setting each of the discharge cells into a state of either the light emitting cell or the non-light emitting cell; a light emission sustaining step of alternately applying sustaining pulses to the plurality of row electrode pairs the number of times corresponding to a weight of each of the subfields so as to allow only the discharge cells which have been set into the state of the light emitting cell in the pixel data writing step to effect a sustain-discharge, in at least one of the plurality of subfields; and a resetting step of applying reset pulses to all of the row electrodes of the plurality of row electrode pairs prior to the pixel data writing step, allowing each of the entire discharge cells of the plasma display panel to reset-discharge, and initializing all of the discharge cells, and a trailing edge portion of the reset pulse which is applied finally among the reset pulses which are applied in the resetting step has undershoot part below a ground potential.

BRIEF DESCRIPTION OF THE DRAWINGS

FIG. 2 is a diagram showing an example of a data conversion table of a pixel drive data forming circuit 30 and a light emission driving pattern in one field display period of time;

FIG. 16 is a diagram showing a correspondence relation between a luminance mode and a ratio of the number of times of light emission which is executed in a sustaining light emitting step of each subfield;

FIG. 18 is a diagram showing an example of a pattern of the light emission driving which is executed on the basis of the light emission driving format in FIG. 3;

DETAILED DESCRIPTION OF THE PREFERRED EMBODIMENTS

Embodiments of the invention will be described in detail hereinbelow with reference to the drawings.

Figure 1:
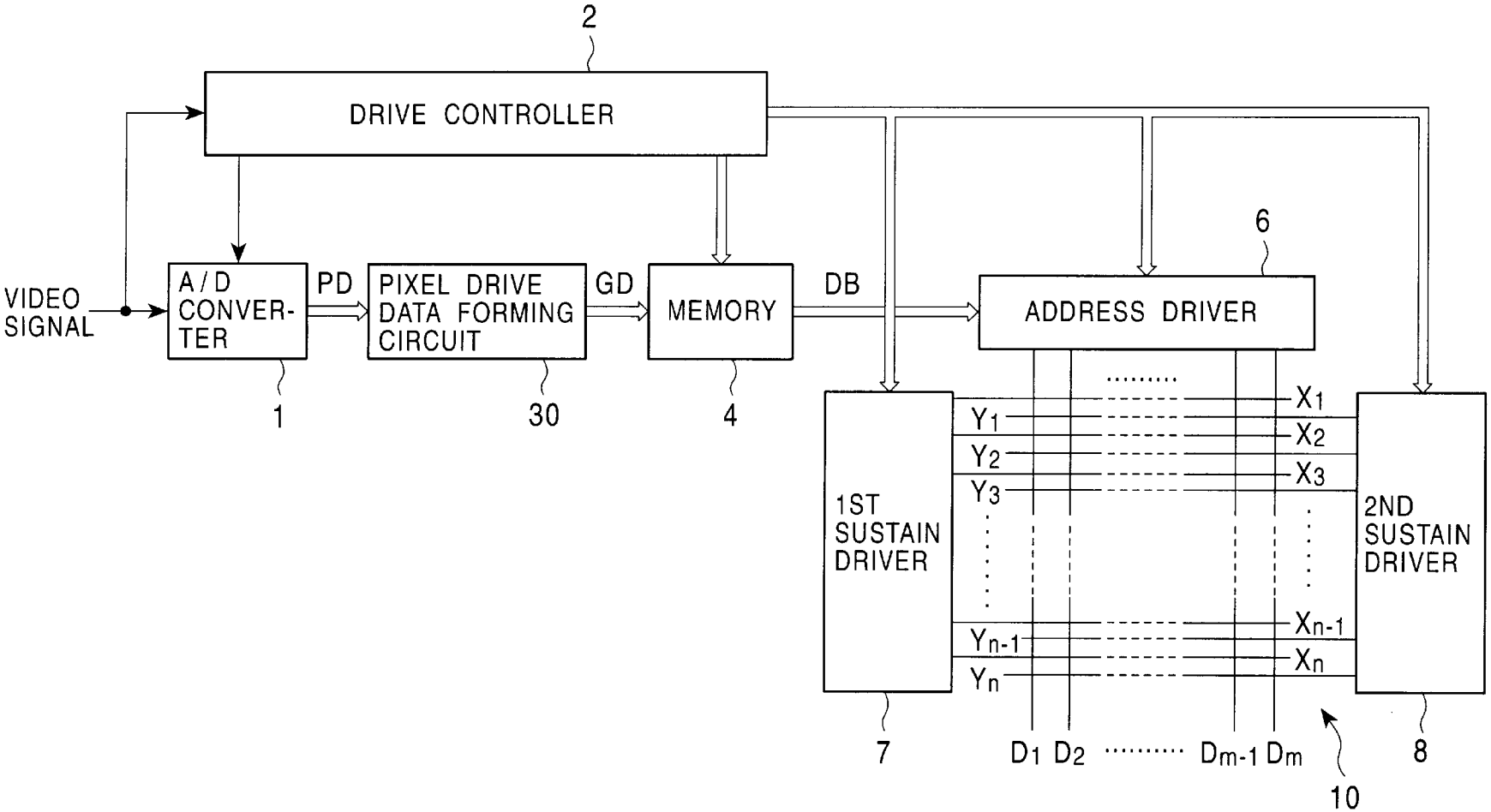
FIG. 1 is a diagram showing a schematic construction of a display apparatus according to the invention.

FIG. 1 is a diagram showing a schematic construction of a plasma display apparatus according to the invention.

In FIG. 1, a PDP 10 as a plasma display panel comprises: m column electrodes $D_1$ to $D_m$; and n row electrodes $X_1$ to $X_n$ and n row electrodes $Y_1$ to $Y_n$ arranged so as to cross each of the column electrodes. The row electrodes $X_1$ to $X_n$ and row electrodes $Y_1$ to $Y_n$ construct a first display line to an nth display line in the PDP 10 by pairs of row electrodes $X_i$ ($1 \leqq i \leqq n$) and $Y_i$ ($1 \leqq i \leqq n$), respectively. A discharge space filled with a discharge gas is formed between the column electrode D and the row electrodes X and Y. A discharge cell which performs a discharge light emission in red, a discharge cell which performs a discharge light emission in green, or a discharge cell which performs a discharge light emission in blue is formed at each intersecting portion of each row electrode pair and the column electrode including the discharge space.

An A/D converter 1 samples an analog input video signal in accordance with a clock signal supplied from a drive controller 2 and converts it into pixel data PD of, for example, 4 bits corresponding to each pixel. A pixel drive data forming circuit 30 converts the 4-bit pixel data PD into pixel drive data GD of 14 bits in accordance with a data conversion table as shown in FIG. 2 and supplies it to a memory 4. The memory 4 sequentially writes the pixel drive data GD in accordance with a write signal which is supplied from the drive controller 2. When the writing of the data of one picture plane (n rows, m columns) is finished by the writing operation, the memory 4 divides pixel drive data $GD_{11\text{-}nm}$ of one picture plane into data for each bit digit, reads out the divided data, and sequentially supplies them to an address driver 6 for each row (m data). That is, first, the memory 4 extracts only the first bit of each of the pixel drive data $GD_{11\text{-}nm}$, reads out them as pixel drive data bits $DB1_{11\text{-}nm}$, and sequentially supplies them to the address driver 6 for each row. Subsequently, the memory 4 extracts only the second bit of each of the pixel drive data $GD1_{11\text{-}nm}$, reads out them as pixel drive data bits $DB2_{11\text{-}nm}$, and sequentially supplies them to the address driver 6 for each row. In a manner similar to the above, the memory 4 extracts the 3rd to 14th bits of the pixel drive data $GD_{11\text{-}nm}$, reads out them as pixel drive data bits $DB3_{11\text{-}nm}$, to $DB14_{11\text{-}nm}$ of for each bit, and sequentially supplies them to the address driver 6 for each row.

The drive controller 2 supplies the clock signal to the A/D converter 1 and write/read signals to the memory 4 synchronously with horizontal and vertical sync signals in the input video signal. Further, the drive controller 2 generates various timing signals for driving the address driver 6, a first sustain driver 7, and a second sustain driver 8 synchronously with the horizontal and vertical sync signals, respectively.

The address driver 6 generates m pixel data pulses having a voltage corresponding to a logic level of each of the pixel drive data bits DB of each row read out from the memory 4 and applies them to the column electrodes $D_1$ to $D_m$ of the PDP 10, respectively. Each of the first sustain driver 7 and the second sustain driver 8 generates various driving pulses for allowing the discharge cells of the PDP 10 to perform various discharges and applies them to the row electrodes $X_1$ to $X_n$ and $Y_1$ to $Y_n$ of the PDP 10, respectively. The drive controller 2 controls each of the address driver 6, first sustain driver 7, and second sustain driver 8 so as to gradation drive the PDP 10 in accordance with a light emission driving format as shown in FIG. 3.

Figure 3:
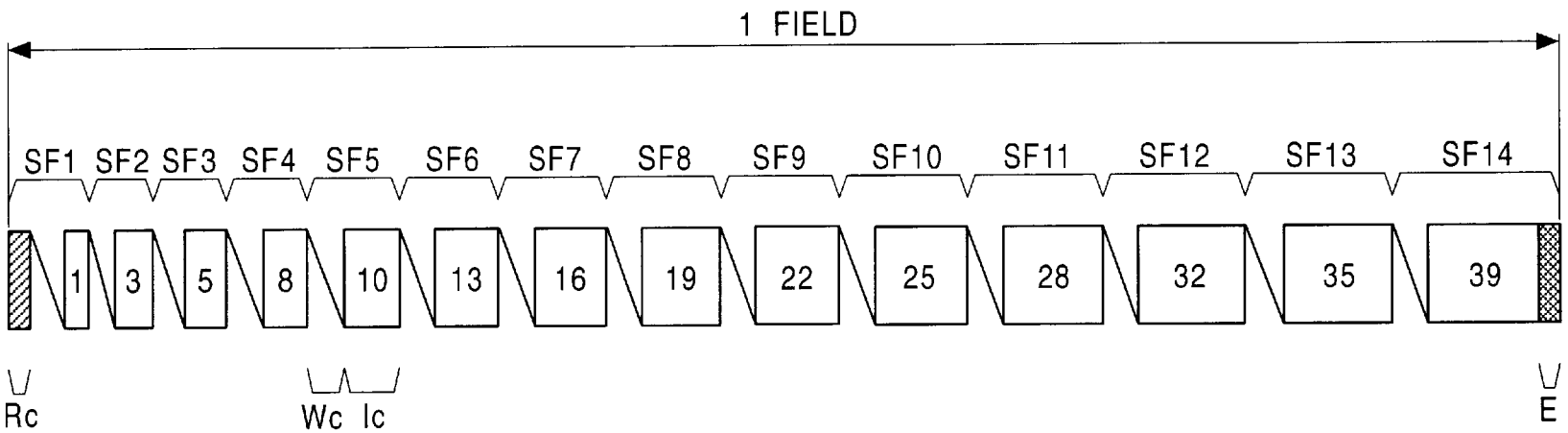
FIG. 3 is a diagram showing an example of a light emission driving format.

In the light emission driving format shown in FIG. 3, a display period of time of one field is divided into 14 subfields SF1 to SF14, and the PDP 10 is driven in each subfield. In this driving format, an addressing step Wc and a light emission sustaining step Ic are executed in each subfield. An all-resetting step Rc is executed only in the head subfield SF1. An erasing step E is executed only in the last subfield SF14.

Figure 4:
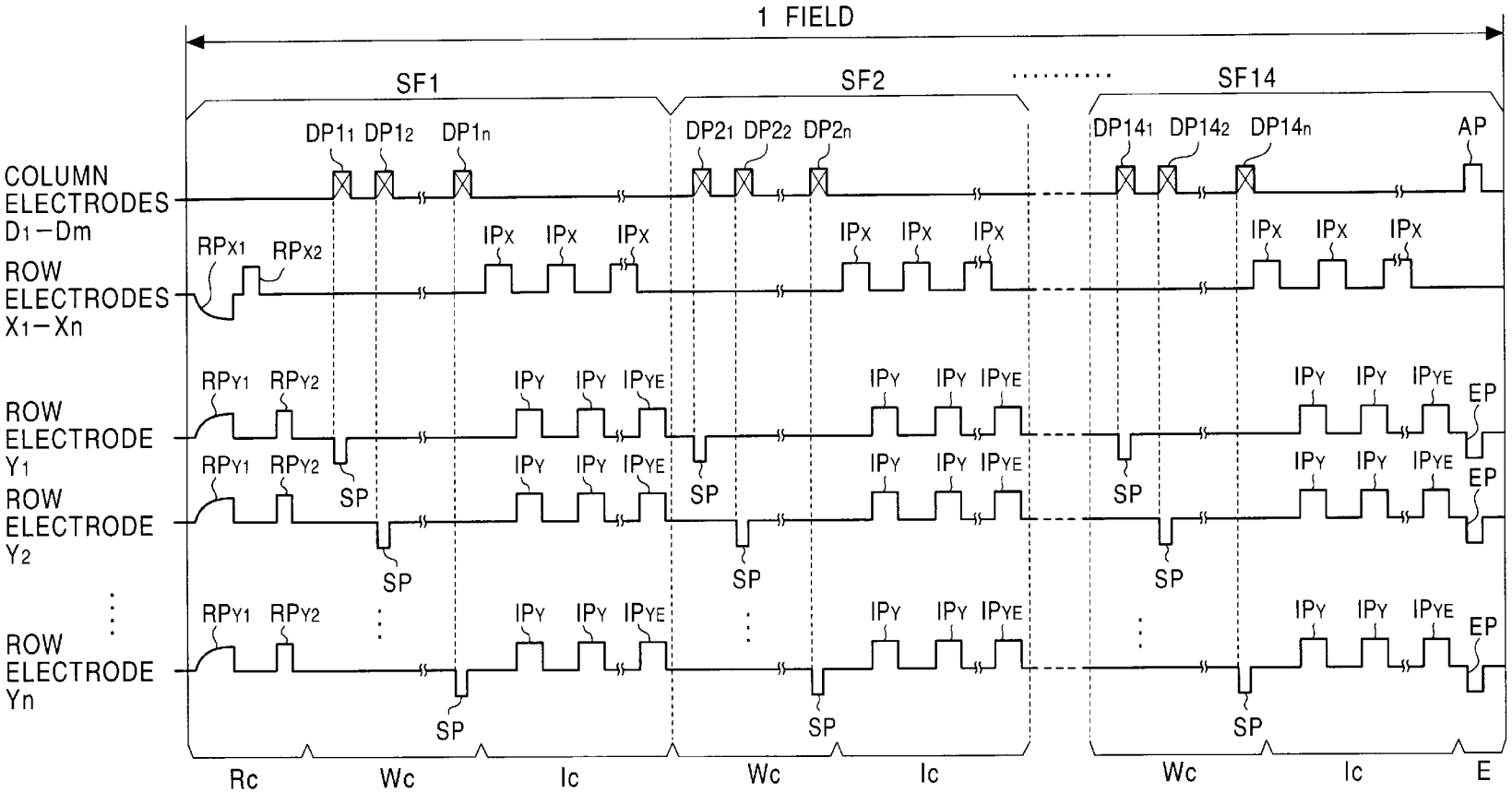
FIG. 4 is a diagram showing examples of various driving pulses which are applied to a PDP 10 and their applying timings.

FIG. 4 is a diagram showing the various driving pulses which are applied from the address driver 6, first sustain driver 7, and second sustain driver 8 to the PDP 10 in the all-resetting step Rc, addressing step Wc, light emission sustaining step Ic, and erasing step E, and their applying timings.

First, in the all-resetting step Rc which is executed in the head subfield SF1, each of the first sustain driver 7 and the second sustain driver 8 simultaneously applies first reset pulses $RP_{x1}$ and $RP_{Y1}$ having waveforms as shown in FIG. 4 to the row electrodes $X_1$ to $X_n$ and $Y_1$ to $Y_n$ of the PDP 10, respectively. All of the discharge cells in the PDP 10 are, thus, reset-discharged and a predetermined amount of wall charges are uniformly formed in each discharge cell. Just after the application of the first reset pulses $RP_{X1}$ and $RP_{Y1}$, the first sustain driver 7 simultaneously applies second reset pulse $RP_{X2}$ as shown in FIG. 4 to the row electrodes $X_1$ to $X_n$, respectively. Further, just after the application of the second reset pulse $RP_{X2}$, the second sustain driver 8 simultaneously applies third reset pulses $RP_{Y2}$ as shown in FIG. 4 to the row electrodes $Y_1$ to $Y_n$, respectively. In this process, each time the second reset pulse $RP_{X2}$ and the third reset pulse $RP_{Y2}$ are applied, the reset discharge is caused in each discharge cell, and a desired amount of priming particles are formed in the discharge space.

Subsequently, in the addressing step Wc, the address driver 6 forms pixel data pulses having a voltage corresponding to the logic level of each of the pixel drive data bits DB for one row (m data pieces) supplied from the memory 4, and applies a pixel data pulse group DP comprising m pixel data pulses to the column electrodes $D_1$ to $D_m$. That is, in the addressing step Wc of the subfield SF1, the address driver 6 sequentially applies a pixel data pulse group DP1 having a voltage according to the logic level of each of the pixel drive data bits $DB1_{11-nm}$ to the column electrodes $D_1$ to $D_m$ for each display line ($DP1_1$, $DP1_2$, $DP1_3$, . . . , $DP1_n$), respectively. In the addressing step Wc of the subfield SF2, the address driver 6 sequentially applies a pixel data pulse group DP2 having a voltage according to the logic level of each of the pixel drive data bits $DB2_{11-nm}$ to the column electrodes $D_1$ to $D_m$ for each display line ($DP2_1$, $DP2_2$, $DP2_3$, . . . , $DP2_n$), respectively. In a manner similar to the above, in the addressing step Wc of each of the subfields SF3 to SF14, the address driver 6 sequentially applies the pixel data pulse group DP (DP3 to DP14) having a voltage according to the logic level of each of the pixel drive data bits DB ($DB3_{11-nm}$ to $DB14_{11-nm}$) to the column electrodes $D_1$ to $D_m$ for each display line, respectively. When the pixel drive data bits DB are at the logic level "0", the address driver 6 forms the pixel data pulses of the low voltage (0 volt). When the pixel drive data bits DB are at the logic level "1", the address driver 6 forms the pixel data pulses of the high voltage.

Further, in the addressing step Wc, the second sustain driver 8 generates scanning pulses SP as shown in FIG. 4 at the same timings as the applying timings of each pixel data pulse group DP and sequentially applies them to the row electrodes $Y_1$ to $Y_n$, respectively. In this process, a discharge (selective erasure discharge) selectively occurs only in the discharge cell in a intersecting portion of the "row" to which the scanning pulse SP has been applied and the "column" to which the pixel data pulse of the high voltage has been applied, and the wall charges remaining in the discharge cell are erased. The discharge cell in which the selective erasure discharge was triggerred and the wall charges have been extinguished is set into the "light-off discharge cell" state. Since the wall charges remain in the discharge cell in which the selective erasure discharge is not caused, the discharge cell is set into the "light-on discharge cell" state.

That is, by the execution of the addressing step Wc, the light emitting cell which is discharged and emits the light in the light emission sustaining step Ic, which will be explained later, and the non-light emitting cell held in the light-off state are alternatively set in accordance with the pixel data. What is called writing of the pixel data into each discharge cell is performed.

Subsequently, in the light emission sustaining step Ic which is executed in each of the subfields SF1 to SF14, the first sustain driver 7 and the second sustain driver 8 alternately and repetitively apply sustaining pulses $IP_X$ and $IP_Y$ to the row electrodes $X_1$ to $X_n$ and $Y_1$ to $Y_n$ as shown in FIG. 4. The number of times of the sustaining pulses IP which are applied in the light emission sustaining step Ic differs for each subfield as shown in FIG. 3.

That is, assuming that the number of applications in the light emission sustaining step Ic in the subfield SF1 is "1", the number of applications in the light emission sustaining step Ic in each of the subfields SF1 to SF14 is as follows.

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

In this case, the discharge cells in which the wall charges remain, that is, only the discharge cells set into the "light-on discharge cell" state in the addressing step Wc effect a sustain-discharge each time the sustaining pulses $IP_X$ and $IP_Y$ are applied, and maintain the light emitting state associated by the sustain discharge the number of discharging times allocated to each subfield. The sustain discharge which is caused lastly in the light emission sustaining step Ic of for each subfield also plays a role of adjusting an amount of wall charges remaining in each discharge cell to a proper amount in order to properly cause the selective erasure discharge in the addressing step Wc of the next subfield.

Whether each discharge cell is set into the "light-on discharge cell" state in the addressing step Wc or not is determined by the pixel drive data GD formed on the basis of the input video signal. The pixel drive data GD of 14 bits can have 15 patterns as shown in FIG. 2. In FIG. 2, the pixel drive data GD has the bit patterns in which the number of bits in which the logic level is "1" among the first to fourteenth bits is equal to 1 or less. Therefore, according to the driving scheme which uses the pixel drive data GD, as shown by ● (black circles) in FIG. 2, the selective erasure discharge is caused only in the addressing step Wc in one of the subfields SF1 to SF14. That is, by the execution of the all-resetting step Rc, the sustain discharge is caused in the light emission sustaining step Ic in each of the continuous subfields existing during the above time interval since the wall charges formed in all of the discharge cells of the PDP 10 remain for a period of time until the selective erasure discharge is effected. That is, each discharge cell is held in the "light-on discharge cell" state for a period of time until the selective erasure discharge is caused in one field period of time, and the discharge cells continuously emit the light in the subfields (shown by ○ (white circles)) existing during the above time interval.

In the erasing step E which is executed only in the last subfield SF14, the address driver 6 generates erasing pulses AP and applies them to each of the column electrodes $D_{1-m}$. Further, the second sustain driver 8 generates erasing pulses EP simultaneously with the applying timings of the erasing pulses AP and applies them to each of the row electrodes $Y_1$ to $Y_n$. By the simultaneous application of the erasing pulses AP and EP, the erasure discharge is caused in all of the discharge cells in the PDP 10, and the wall charges remaining in all of the discharge cells are extinguished.

By executing the driving according to the light emission driving format shown in FIG. 3 by using the pixel drive data GD comprising 15 patterns as shown in FIG. 2, therefore, intermediate luminance of 15 levels comprising {0,1,4,9,17,27,40,56,75,97,122,150,182,217,255} can be expressed. A display image corresponding to the input video signal is displayed on the screen of the PDP 10.

Figure 5:
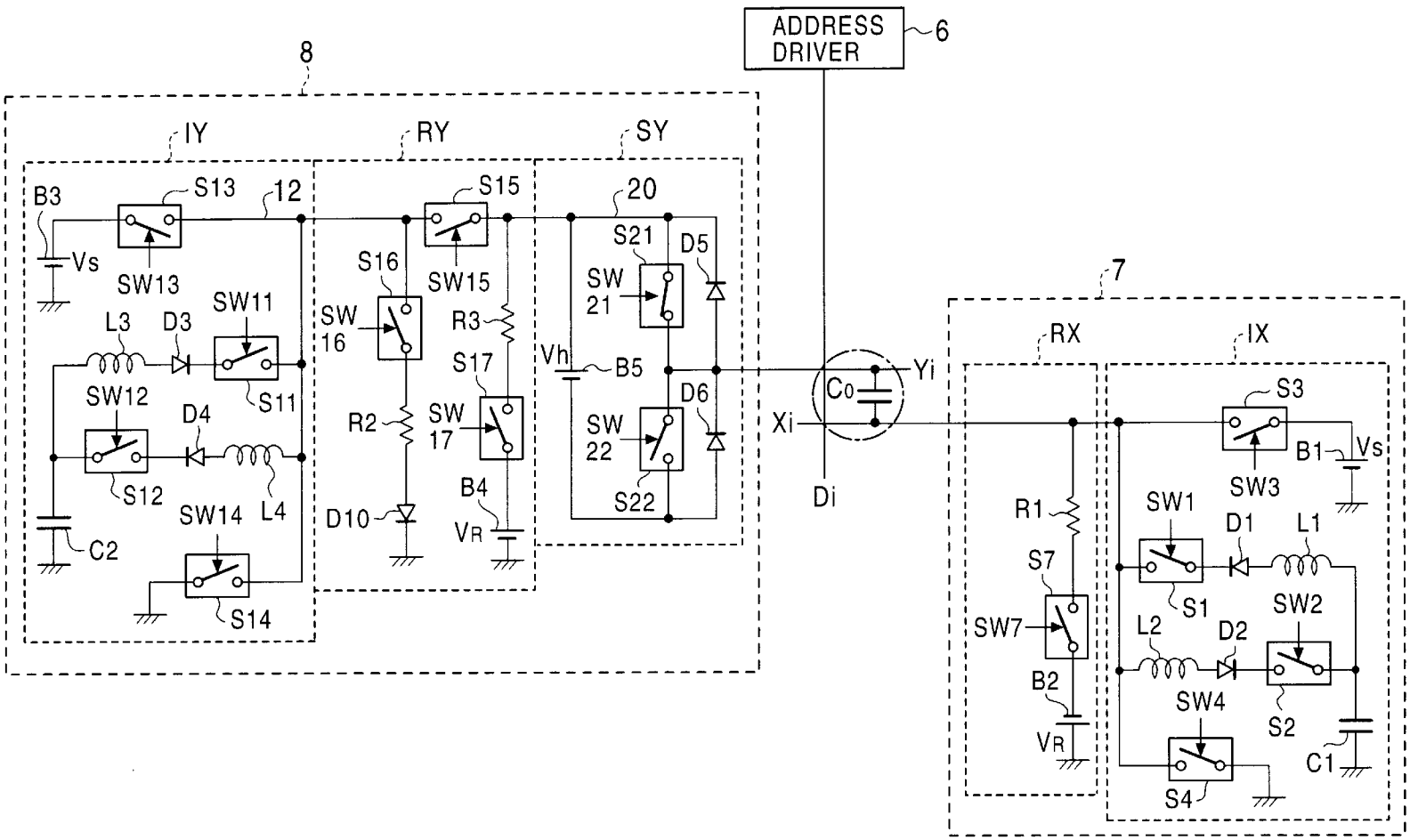
FIG. 5 is a diagram showing an example of an internal construction of each of a first sustain driver 7 and a second sustain driver 8 shown in FIG. 1.

FIG. 5 is a diagram showing an example of an internal construction of each of the first sustain driver 7 and the second sustain driver 8 for generating the reset pulses RP, scanning pulses SP, sustaining pulses IP, and erasing pulses EP, respectively.

As shown in FIG. 5, the first sustain driver 7 is provided with: a reset pulse generating circuit RX for generating the reset pulses $RP_x$; and a sustaining pulse generating circuit IX for generating the sustaining pulses $IP_x$.

The reset pulse generating circuit RX is made up of: a DC power source B2 for generating a DC voltage $V_R$; a switching device S7; and a resistor R1. A positive side terminal of the DC power source B2 is set to the ground potential and a negative side terminal is connected to the switching device S7. The switching device S7 is turned on during a period of time when a switching signal SW7 supplied from the drive controller 2 is at the logic level "1", thereby allowing a voltage $-V_R$ as a negative side terminal voltage of the DC power source B2 to be applied to the row electrode X via the resistor R1.

Figure 6:
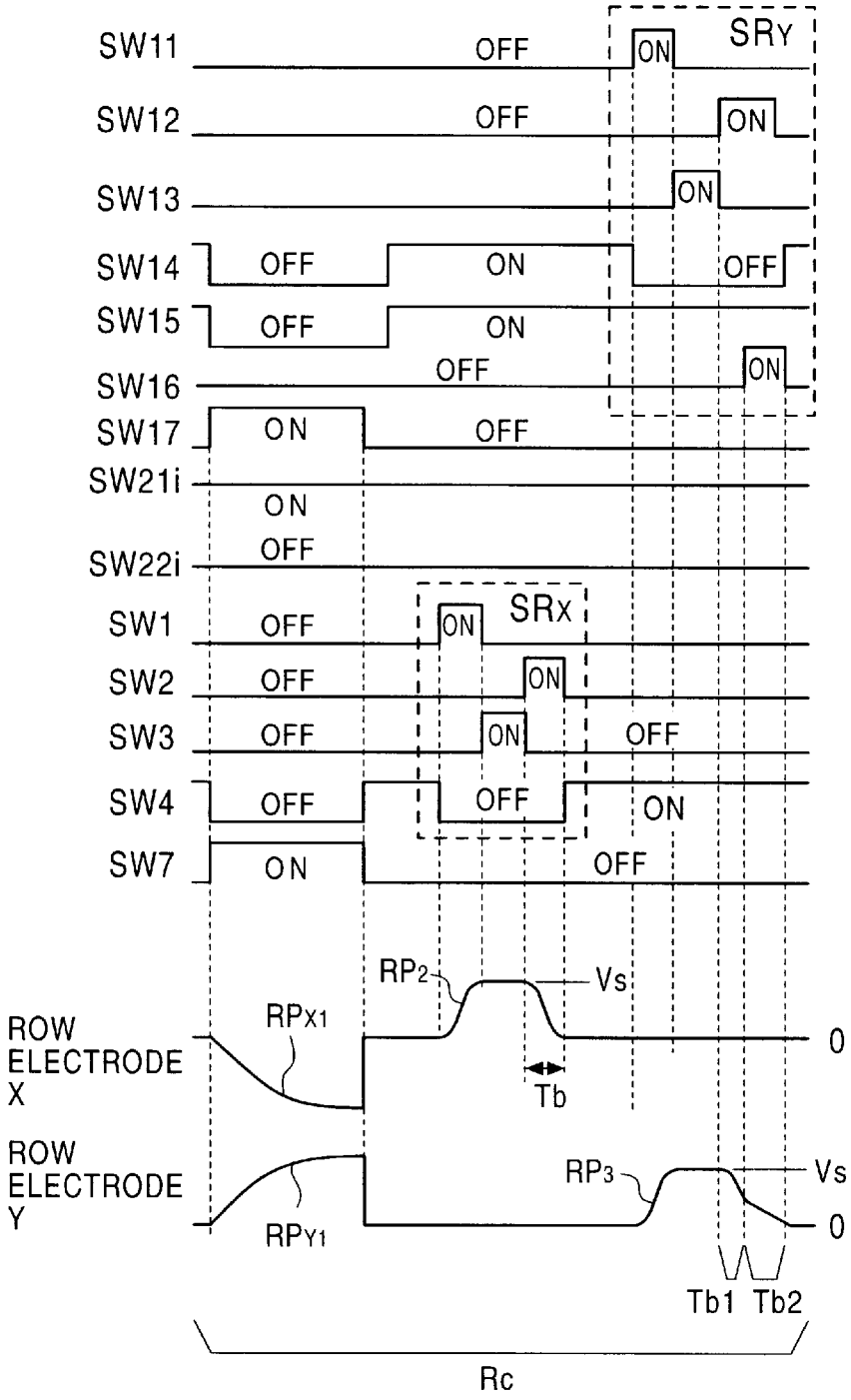
FIG. 6 is a diagram showing examples of various reset pulses which are applied to the PDP 10 and a switching sequence at the time of generating each reset pulse.

When the switching signal SW7 is supplied from the drive controller 2 to sequentially switch the switch device S7 to OFF state→ ON state→ OFF state in accordance with a sequence as shown in FIG. 6, the reset pulse generating circuit RX generates the first reset pulse $RP_{X1}$ of a negative polarity whose trailing edge change is smooth as shown in FIG. 6.

The sustaining pulse generating circuit IX is made up of: a DC power source B1 for generating a DC voltage $V_s$; switching devices S1 to S4; coils L1 and L2; diodes D1 and D2; and a capacitor C1. The switching device S1 is turned on only during a period of time when a switching signal SW1 supplied from the drive controller 2 is at the logic level "1", thereby allowing the electric potential on one end of the capacitor C1 to be applied to the row electrode X via the coil L1 and diode D1. The switching device S2 is turned on only during a period of time when a switching signal SW2 supplied from the drive controller 2 is at the logic level "1", thereby allowing the electric potential on the row electrode X to be applied to one end of the capacitor C1 via the coil L2 and diode D2. The switching device S3 is turned on only during a period of time when a switching signal SW3 supplied from the drive controller 2 is at the logic level "1", thereby allowing the voltage $V_s$ generated by the DC power source B1 to be applied to the row electrode X. The switching device S4 is turned on only during a period of time when a switching signal SW4 supplied from the drive controller 2 is at the logic level "1", thereby setting the row electrode X to the ground potential.

Figure 7:
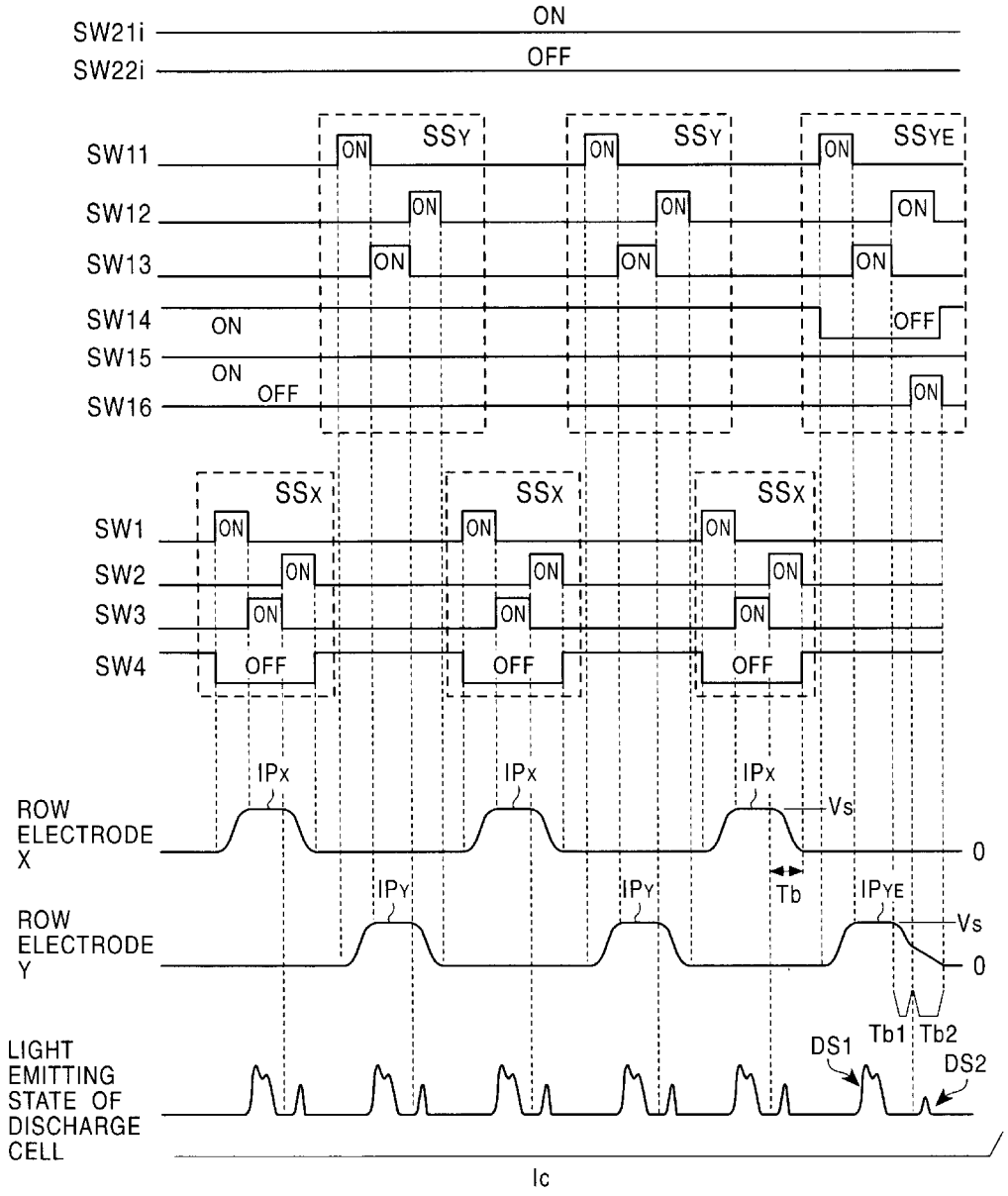
FIG. 7 is a diagram showing examples of various sustaining pulses which are applied to the PDP 10 and a switching sequence at the time of generating each sustaining pulse.

The sustaining pulse generating circuit IX generates the sustaining pulses $IP_X$ in accordance with the switching signals SW1 to SW4 which are level-shifted in accordance with a switching sequence $SS_x$ as shown in FIG. 7. That is, first, only the switching device S1 is turned on in accordance with the switching signal SW1 at the logic level "1", so that the current based on the charges accumulated in the capacitor C1 flows into the discharge cell via the coil L1, diode D1, and row electrode X. The voltage on the row electrode X, thus, rises gradually as shown in FIG. 7. Subsequently, only the switching device S3 is turned on in accordance with the switching signal SW3 at the logic level "1", so that the voltage $V_s$ generated by the DC power source B1 is applied immediately to the row electrode X. The voltage on the row electrode X, thus, becomes the voltage $V_s$ as shown in FIG. 7. Subsequently, only the switching device S2 is turned on in accordance with the switching signal SW2 at the logic level "1", so that the current based on the charges accumulated in a load capacitor $C_O$ between the row electrodes X and Y flows into the capacitor C1 via the coil L2 and the diode D2. The voltage on the row electrode X, thus, drops gradually as shown in FIG. 7.

The drive controller 2 periodically and repetitively executes the control according to the switching sequence $SS_X$ as many times as the number of discharges allocated to each subfield as mentioned above. The sustaining pulse generating circuit IX, thus, repetitively generates the sustaining pulses $IP_X$ having a waveform as shown in FIG. 7 as many times as the number of discharges allocated to each subfield as shown in FIG. 4.

As shown in FIG. 5, the second sustain driver 8 is provided with: a reset pulse generating circuit RY for generating the reset pulses $RP_Y$; a scanning pulse generating circuit SY for generating the scanning pulses SP; and a sustaining pulse generating circuit IY for generating the sustaining pulses $IP_Y$ and $IP_{YE}$.

The reset pulse generating circuit RY is made up of: a DC power source B4 for generating the DC voltage $V_R$; switching devices S15 to S17; a diode D10; and resistors R2 and R3. A negative side terminal of the DC power source B4 is connected to the ground and a positive side terminal is connected to the switching device S17. The switching device S17 is turned on only during a period of time when a switching signal SW17 supplied from the drive controller 2 is at the logic level "1", thereby allowing the voltage $V_R$ as a positive side terminal voltage of the DC power source B4 to be applied onto a line 20 via the resistor R3. A cathode terminal of the diode D10 is set to the ground potential. An anode terminal of the diode D10 is connected to one end of the resistor R2 and the switching device S16 is connected to the other end. The switching device S16 is turned on only during a period of time when a switching signal SW16 supplied from the drive controller 2 is at the logic level "1", thereby connecting the other end of the resistor R2 and a line 12.

When the switching signal SW17 to sequentially switch the switching device S17 to OFF state→ ON state→ OFF state as shown in FIG. 6 is supplied from the drive controller 2, the reset pulse generating circuit RY generates the first reset pulse $RP_{Y1}$ of a positive polarity whose leading edge change is smooth as shown in FIG. 6.

The scanning pulse generating circuit SY is made up of: a DC power source B5 which is provided for each of the row electrodes $Y_1$ to $Y_n$ and generates a DC voltage $V_h$; switching devices S21 and S22; and diodes D5 and D6. The switching device S21 is turned on only during a period of time when a switching signal SW21 supplied from the drive controller 2 is at the logic level "1", thereby connecting a positive side terminal of the DC power source B5 and an anode terminal of the diode D5 to the row electrode Y, respectively. The switching device S22 is turned on only during a period of time when a switching signal SW22 supplied from the drive controller 2 is at the logic level "1", thereby connecting a negative side terminal of the DC power source B5 and a cathode terminal of the diode D6 to the row electrode Y, respectively. In this process, the drive controller 2 sequentially supplies the switching signal SW21 at the logic level "0"and the switching signal SW22 at the logic level "1"to each of the scanning pulse generating circuits SY corresponding to the row electrodes $Y_1$ to $Y_n$, respectively. In the scanning pulse generating circuits SY to which the switching signals SW21 and SW22 were supplied, the switching device S22 is turned on and the switching device S21 is turned off. The scanning pulses SP of the negative polarity having a voltage $-V_h$ as shown in FIG. 4 are, thus, generated onto the row electrode Y corresponding to the scanning pulse generating circuit SY.

The sustaining pulse generating circuit IY is made up of: a DC power source B3 for generating the DC voltage $V_s$; switching devices S11 to S14; coils L3 and L4; diodes D3 and D4; and a capacitor C2. The switching device S11 is turned on only during a period of time when a switching signal SW11 supplied from the drive controller 2 is at the logic level "1", thereby allowing the electric potential on one end of the capacitor C2 to be applied onto the line 12 via the coil L3 and the diode D3. The switching device S12 is turned on only during a period of time when a switching signal SW12 supplied from the drive controller 2 is at the logic level "1", thereby allowing the electric potential on the line 12 to be applied to one end of the capacitor C2 via the coil L4 and the diode D4. The switching device S13 is turned on only during a period of time when a switching signal SW13 supplied from the drive controller 2 is at the logic level "1", thereby allowing the voltage $V_s$ generated by the DC power source B3 to be applied onto the line 12. The switching device S14 is turned on only during a period of time when a switching signal SW14 supplied from the drive controller 2 is at the logic level "1", thereby setting the line 12 to the ground potential.

The sustaining pulse generating circuit IY generates the sustaining pulses $IP_Y$ in accordance with the switching signals SW11 to SW14 which are level-shifted in accordance with a switching sequence $SS_Y$ as shown in FIG. 7. That is, first, only the switching device S11 is turned on in accordance with the switching signal SW11 at the logic level "1". In this process, the current based on the charges accumulated in the capacitor C2 flows into the row electrode Y via the coil L3, diode D3, and switching devices S11, S15, and S21. The voltage on the row electrode Y, thus, rises gradually as shown in FIG. 7. Subsequently, only the switching device S13 is turned on in accordance with the switching signal SW13 at the logic level "1", so that the voltage $V_s$ generated by the DC power source B3 is applied immediately to the row electrode Y. The voltage on the row electrode Y, thus, becomes the voltage $V_s$ as shown in FIG. 7. Subsequently, only the switching device S12 is turned on in accordance with the switching signal SW12 at the logic level "1", so that the current based on the charges accumulated in the load capacitor $C_O$. between the row electrodes X and Y flows into the capacitor C2 via the coil L4 and the diode D4. The voltage on the row electrode Y, thus, drops gradually as shown in FIG. 7.

The drive controller 2 periodically and repetitively executes the control according to the switching sequence $SS_Y$ the number of times as many as the number of discharging times allocated to each subfield as mentioned above. As shown in FIG. 4, the sustaining pulse generating circuit IY, thus, repetitively generates the sustaining pulses $IP_Y$ having a waveform as shown in FIG. 7. Only at the end of the light emission sustaining step Ic, the drive controller 2 executes the control according to the switching sequence $SS_{YE}$ as shown in FIG. 7. The sustaining pulse generating circuit IY, thus, generates only the last sustaining pulse $IP_{YE}$ among the sustaining pulses which are repetitively generated in the light emission sustaining step Ic of each of the subfields SF1 to SF14.

The operation of generating the sustaining pulse $IP_{YE}$ will be described hereinbelow with reference to FIG. 7.

In the control operation according to the switching sequence $SS_{YE}$ the switching signal SW11 at the logic level "1"is first supplied to the sustaining pulse generating circuit IY and only the switching device S11 is turned on. In this process, the current based on the charges accumulated in the capacitor C2 flows into the row electrode Y via the coil L3, diode D3, and switching devices S11, S15, and S21. The voltage on the row electrode Y, thus, rises. Subsequently, only the switching device S13 is turned on in accordance with the switching signal SW13 at the logic level "1" and the voltage $V_s$ generated by the DC power source B3 is applied immediately to the row electrode Y. The voltage on the row electrode Y, thus, becomes the voltage $V_s$. Subsequently, only the switching device S12 is turned on in accordance with the switching signal SW12 at the logic level "1" and the current based on the charges accumulated in the load capacitor $C_O$ between the row electrodes X and Y flows into the capacitor C2 via the coil L4 and the diode D4. The voltage on the row electrode Y, thus, drops gradually as shown in FIG. 7 (resonance trailing interval Tb1). During the voltage drop, the drive controller 2 switches the switching signal SW12 to the logic level "0" and switches the switching signal SW16 to the logic level "1", respectively. A serial circuit comprising the resistor R2 and the diode D10 is connected to the line 12, and, during the period of time, the voltage drop on the row electrode Y becomes further mild as shown in FIG. 7 (resistance trailing interval Tb2).

A change rate of the voltage value in the trailing interval (Tb1+Tb2) of the sustaining pulse $IP_{YE}$ becomes milder than that in the trailing interval Tb of the sustaining pulse $IP_Y$ or $IP_X$ which is applied just before it.

The discharge (DS1, DS2 shown in FIG. 7) which is caused in accordance with the sustaining pulse that is applied at the end of the light emission sustaining step Ic also plays a role for adjusting an amount of wall charges remaining in the discharge cell to a proper amount in order to properly cause the selective erasure discharge in the addressing step Wc. If the voltage transition in the training interval of the last sustaining pulse, however, is steep in a manner similar to other sustaining pulses and the amount of wall charges remaining in the discharge cell just before the last sustaining pulse is applied is large, the following problems are caused.

For example, if a light emission load in one subfield (the number of discharge cells in which the sustain discharge is caused in one picture plane) is large, a waveform of the sustaining pulse is deformed and the amount of remaining wall charges, for example, increases. If the discharge cell adjacent to the discharge cells in which the sustain discharge was caused for a predetermined time is shifted from the light-off state to the light-on state, since the discharge easily occurs, many wall charges are formed. As mentioned above, if the amount of wall charges remaining in the discharge cell is large, the discharge DS2 which is caused in the trailing interval of the last sustaining pulse in the light emission sustaining step Ic becomes a relatively strong discharge and many wall charges are extinguished. A problem such that the wall charges of the amount enough to properly cause the selective erasure discharge in the addressing step Wc cannot be allowed to remain, thus, occurs.

The following problem occurs also in the case where the amount of wall charges remaining in the discharge cell is small. For example, when the number of discharge cells in which the sustain discharge is caused in one picture plane, that is, what is called a light emission load is small, a distortion of the sustaining pulse is also extinguished. In association with it, the amount of wall charges remaining in the discharge cell also decreases. Since the discharge is hard to occur in the discharge cells in which the sustain discharge was caused for a predetermined time, the amount of wall charges which are formed when the sustain discharge is again caused is also small. Even when a temperature of the PDP 10 is high or the time of the continuous display which is performed by the PDP 10 is long, the discharge is likewise hard to occur, so that the amount of wall charges which are formed by the sustain discharge also decreases. In a state where the amount of wall charges remaining in the discharge cells is small as mentioned above, if the last sustain discharge is caused in the light emission sustaining step Ic, the discharge DS2 which is caused in the trailing interval of the last sustaining pulse applied to cause the sustain discharge is relatively weak, and a small amount of wall charges are extinguished. In this process, however, since the amount of wall charges remaining in the discharge cells is inherently small, if the small amount of wall charges are merely extinguished, it is difficult to assure the wall charges of the amount enough to properly cause the selective erasure discharge.

In the invention, therefore, as shown in FIG. 7, the change rate of the voltage value in the trailing interval (Tb1+Tb2) of the sustaining pulse $IP_{YE}$ which is applied at the end of the light emission sustaining step Ic is set to be milder than that of the voltage value in the trailing interval of the sustaining pulse $IP_Y$ just before the last sustaining pulse. If the voltage transition in the trailing interval of the sustaining pulse $IP_{YE}$ which is applied at the end of the light emission sustaining step Ic is set to be mild as mentioned above, the discharge DS2 which is caused in the trailing interval becomes weak. Even if many wall charges remain in the discharge cell, therefore, since the discharge DS2 is weak, an amount of wall charges which are extinguished is suppressed and the wall charges of the amount enough to properly cause the selective discharge in the addressing step Wc can be allowed to remain. If the amount of wall charges remaining in the discharge cell is small, the discharge DS2 which is caused in the trailing interval as mentioned above becomes further weak, so that the proper amount of wall charges as mentioned above can be allowed to remain.

According to the invention, therefore, just before each addressing step Wc, the proper amount of wall charges to correctly cause the selective discharge in the addressing step Wc can be formed in each discharge cell. Since the proper selective discharge corresponding to the input video signal is caused in the addressing step Wc, deterioration of display quality can be suppressed.

In the embodiment, the change rate of the voltage value in the trailing interval is set to be mild only in the sustaining pulse $IP_{YE}$ which is applied at the end of the light emission sustaining step Ic. In the subfield SF1, however, a change rate of a voltage value in a trailing interval of a third reset pulse $RP_{Y2}$ which is applied at the end of the all-resetting step Rc is further set to be mild. The reset pulse $RP_{Y2}$ is formed by the sustaining pulse generating circuit IY and the reset pulse generating circuit RY. The second reset pulse $RP_{X2}$ is formed by the sustaining pulse generating circuit IX.

That is, the sustaining pulse generating circuit IX generates the second reset pulse $RP_{X2}$ in response to the switching signals SW1 to SW4 which are level-shifted in accordance with a switching sequence $SR_X$ as shown in FIG. 6. That is, first, only the switching device S1 is turned on in accordance with the switching signal SW1 at the logic level "1", thereby allowing the current based on the charges accumulated in the capacitor C1 to flow into the discharge cell via the coil L1, diode D1, and row electrode X. The voltage on the row electrode X, thus, rises gradually as shown in FIG. 6. Subsequently, only the switching device S3 is turned on in accordance with the switching signal SW3 at the logic level "1", thereby allowing the voltage $V_s$ generated by the DC power source B1 to be applied immediately to the row electrode X. The voltage on the row electrode X, thus, becomes the voltage $V_s$. as shown in FIG. 6. Subsequently, only the switching device S2 is turned on in accordance with the switching signal SW2 at the logic level "1", thereby allowing the current based on the charges accumulated in the load capacitor $C_O$ between the row electrodes X and Y to flow into the capacitor C1 via the coil L2 and diode D2. The voltage on the row electrode X, thus, drops gradually as shown in FIG. 6.

By the above operation, the second reset pulse $RP_{X2}$ of the positive polarity having a waveform as shown in FIG. 6 is formed on the row electrode X. After that, the sustaining pulse generating circuit IY generates the third reset pulse $RP_{Y2}$ in response to the switching signals SW11 to SW14 and SW16 which are level-shifted in accordance with a switching sequence $SR_Y$ as shown in FIG. 6. That is, first, only the switching device S11 is turned on in accordance with the switching signal SW11 at the logic level "1". In this process, the current based on the charges accumulated in the capacitor C2 flows into the row electrode Y via the coil L3, diode D3, and switching devices S11, S15, and S21. The voltage on the row electrode Y, thus, rises. Subsequently, only the switching device S13 is turned on in accordance with the switching signal SW13 at the logic level "1", thereby allowing the voltage $V_S$ generated by the DC power source B3 to be applied immediately to the row electrode Y. The voltage on the row electrode Y, thus, becomes the voltage $V_s$. Subsequently, only the switching device S12 is turned on in accordance with the switching signal SW12 at the logic level "1", thereby allowing the current based on the charges accumulated in the load capacitor $C_O$ between the row electrodes X and Y to flow into the capacitor C2 via the coil L4 and diode D4. The voltage on the row electrode Y, thus, drops gradually as shown in FIG. 6 (resonance trailing interval Tb1). During the voltage drop, the switching signal SW16 is switched to the logic level "1". For the period of time, the serial circuit comprising the resistor R2 and diode D10 is connected onto the line 12, and the voltage drop on the row electrode Y becomes further mild as shown in FIG. 6 (resistance trailing interval Tb2).

By the operation as mentioned above, as shown in FIG. 6, the third reset pulse $RP_{Y2}$ in which a change rate of the voltage value in the trailing interval (Tb1+Tb2) is milder than that in the trailing interval of the second reset pulse $RP_{X2}$ is applied to all of the row electrodes Y. When the reset pulse $RP_{Y2}$ is applied to all of the row electrodes Y, a reset discharge is caused in all discharge cells and priming particles are generated in the discharge space. Further, a weak discharge is caused in the trailing interval (Tb1+Tb2) of the reset pulse $RP_{Y2}$ and a proper amount of wall charges enough to correctly cause the selective discharge in the addressing step Wc of the subfield SF1 are formed in all of the discharge cells.

In the embodiment, when the change rate of the voltage value in the trailing interval of each of the reset pulse $RP_{Y2}$ and sustaining pulse $IP_{YE}$ is set to be mild, the change rate of the voltage value mainly in the resistance trailing interval Tb2 is set to be mild. The voltage transition, however, can be also set to be mild only in the resonance trailing interval Tb1 or in both of the resonance trailing interval Tb1 and the resistance trailing interval Tb2.

Figure 8:
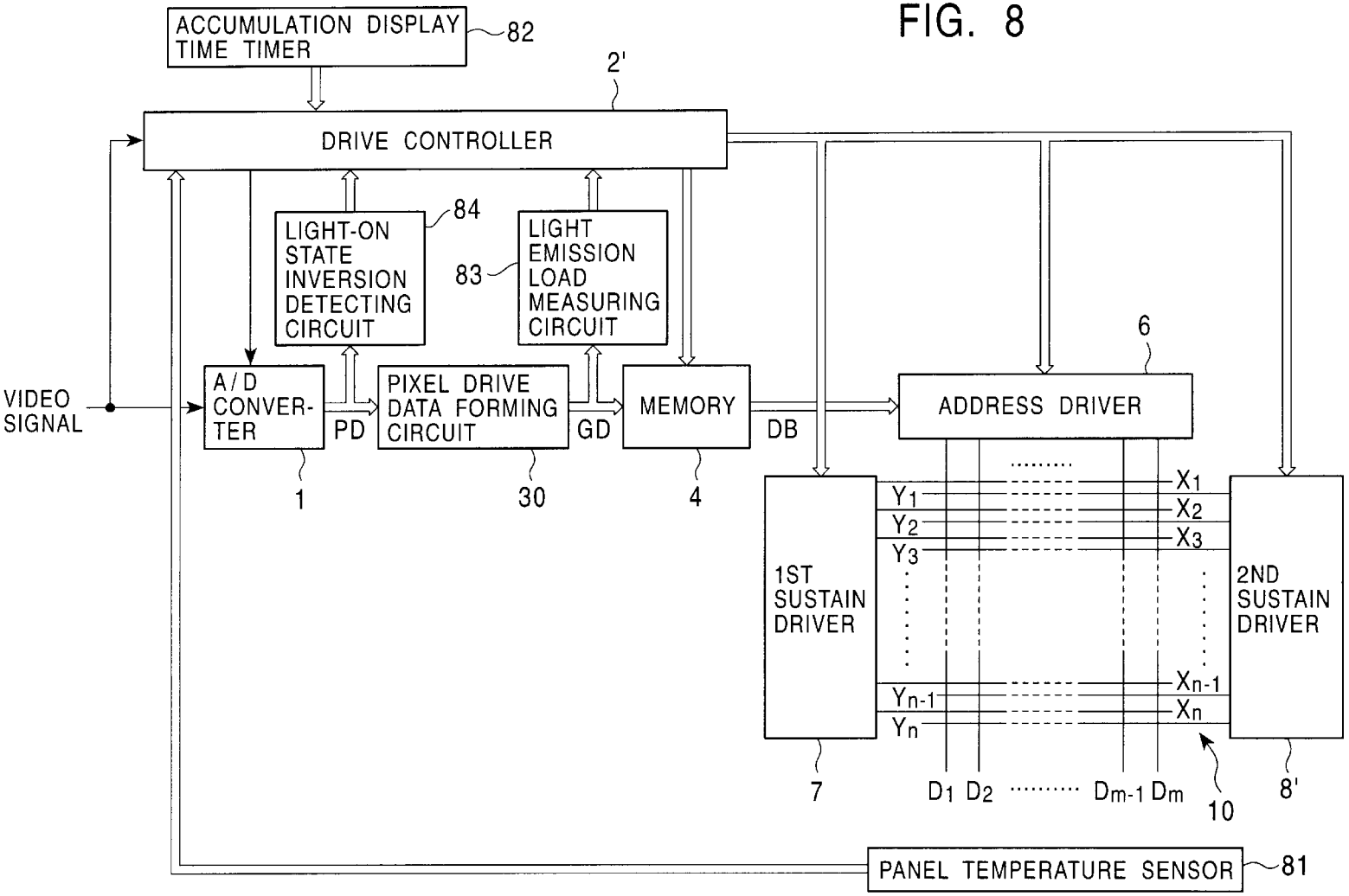
FIG. 8 is a diagram showing a construction of a plasma display apparatus according to another embodiment of the invention.

FIG. 8 is a diagram showing a construction of a plasma display apparatus according to another embodiment of the invention.

In the plasma display apparatus shown in FIG. 8, since a construction comprising the A/D converter 1, pixel drive data forming circuit 30, memory 4, address driver 6, first sustain driver 7, and PDP 10 is substantially the same as that shown in FIG. 1, its description is omitted here. Further, in the plasma display apparatus shown in FIG. 8, since a point that a drive controller 2' drives the PDP 10 in accordance with the driving method described in FIGS. 2 to 4 is also similar to that of the plasma display apparatus shown in FIG. 1, its description is also omitted here.

Figure 9:
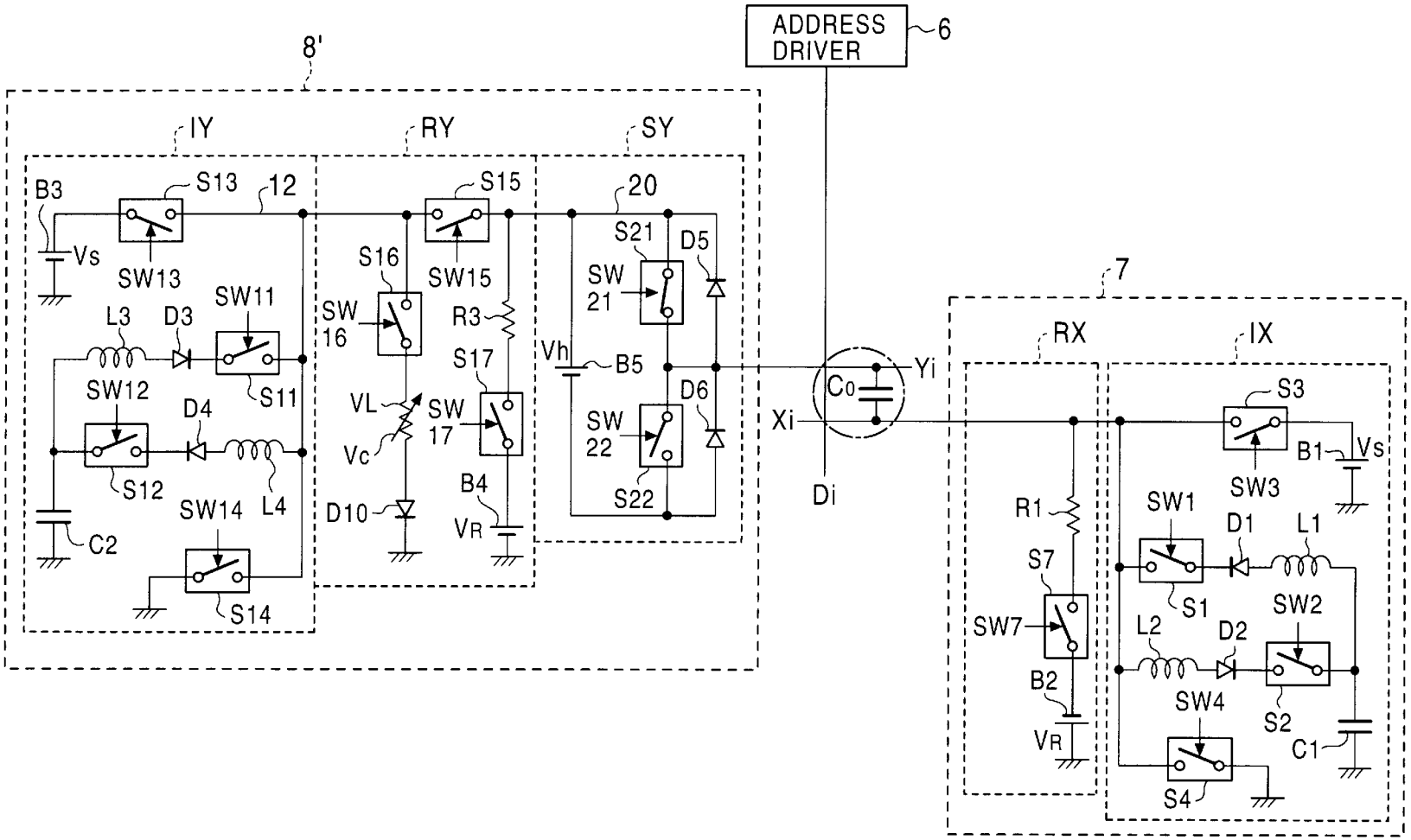
FIG. 9 is a diagram showing an example of an internal construction of each of the first sustain driver 7 and a second sustain driver 8' shown in FIG. 8.

That is, the plasma display apparatus shown in FIG. 8 is obtained by adding a panel temperature sensor 81, an accumulation display time timer 82, a light emission load measuring circuit 83, and a light-on state inversion detecting circuit 84 to the apparatus shown in FIG. 1. Further, in place of the second sustain driver 8 shown in FIG. 1, a second sustain driver 8' having an internal construction as shown in FIG. 9 is used.

In the second sustain driver 8', a construction of each of the sustaining pulse generating circuit IY and the scanning pulse generating circuit SY excluding a reset pulse generating circuit RY' is substantially the same as that of the second sustain driver 8 shown in FIG. 5. In the reset pulse generating circuit RY', in place of the resistor R2 used in the reset pulse generating circuit RY shown in FIG. 5, a variable resistor VL whose resistance value changes in accordance with a voltage change rate adjusting signal Vc supplied from the drive controller 2' is used.

The panel temperature sensor 81 is attached at a position near the PDP 10 and supplies panel temperature information obtained by detecting a panel temperature of the PDP 10 to the drive controller 2'. The accumulation display time timer 82 counts the sum of the image display time which elapsed from the first image display which was performed by the first turn-on of a power source to the present time point after the plasma display apparatus had been manufactured, and supplies information indicative of accumulated display time to the drive controller 2'. The light emission load measuring circuit 83 obtains the number of discharge cells which performs the sustain discharge light emission in one subfield on the basis of the pixel drive data GD supplied from the pixel drive data forming circuit 30, and supplies it as light emission load information indicative of a magnitude of the light emission load to the drive controller 2'. First, the light-on state inversion detecting circuit 84 obtains each of the discharge cells which continuously enter the "light-on discharge cell" state for a predetermined time from all of the discharge cells of the PDP 10 on the basis of the pixel data PD. When the discharge cells formed at positions adjacent to those discharge cells are shifted from the "light-off discharge cell" state to the "light-on discharge cell" state, the light-on state inversion detecting circuit 84 supplies a light-on state inversion detection signal to the drive controller 2'.

The drive controller 2' controls the change rate of the voltage value in the trailing interval of the driving pulse (the sustaining pulse $IP_Y$, the third reset pulse $RP_{Y2}$) which is applied to the PDP 10 just before the addressing step Wc of each subfield on the basis of the panel temperature information, accumulated display time information, light emission load information, or light-on state inversion detection signal.

For example, when the panel temperature of the PDP 10 is relatively high, or the longer the accumulated display time is, or the larger the light emission load is, or the higher a frequency of generation of the light-on state inversion detection signal is, the more the drive controller 2' increases a resistance value of the variable resistor VL of the reset pulse generating circuit RY'. The change rate of the voltage value in the resistance trailing interval Tb2 of each of the reset pulse $RP_{Y2}$ which is applied at the end of the all-resetting step Rc and the sustaining pulse $IP_{YE}$ which is applied at the end of the light emission sustaining step Ic becomes mild by an amount corresponding to the resistance value of the variable resistor VL. In this process, the milder the voltage transition in the trailing interval Tb2 is, the weaker the discharge which is caused in the trailing interval becomes and the more an amount of wall charges which are extinguished is reduced. That is, the amount of wall charges which are extinguished in the trailing interval can be adjusted in accordance with a situation of the panel temperature of the PDP 10, the accumulated display time, the magnitude of the light emission load, the frequency of generation of the light-on state inversion detection signal, or the like.

According to the constructions shown in FIGS. 8 and 9, the amount of wall charges which remain in each discharge cell can be adjusted to the proper amount enough to properly cause the selective discharge in the addressing step Wc in accordance with the various situations as mentioned above.

In the embodiment, the change rate of the voltage value in the resistance trailing interval Tb2 of each of the reset pulse $RP_{Y2}$ and the sustaining pulse $IP_{YE}$ is adjusted by controlling the resistance value of the variable resistor VL, the invention is not limited to the adjusting method.

Figure 10A:
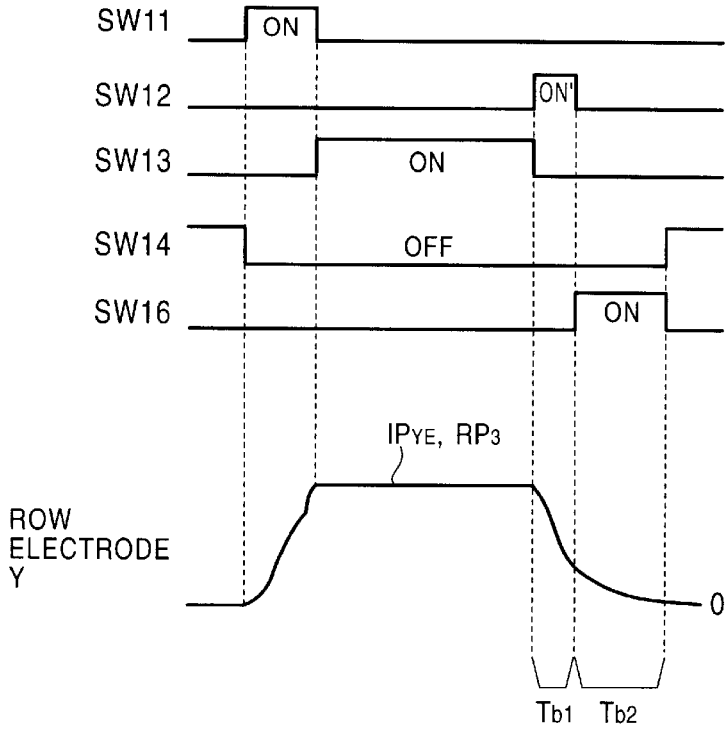
FIGS. 10A and 10B are diagrams showing examples of switching sequences at the time of changing a trailing interval length of a sustaining pulse $IP_{YE}$ or a third reset pulse $RP_3$ in the plasma display apparatus shown in FIG. 8.
Figure 10B:
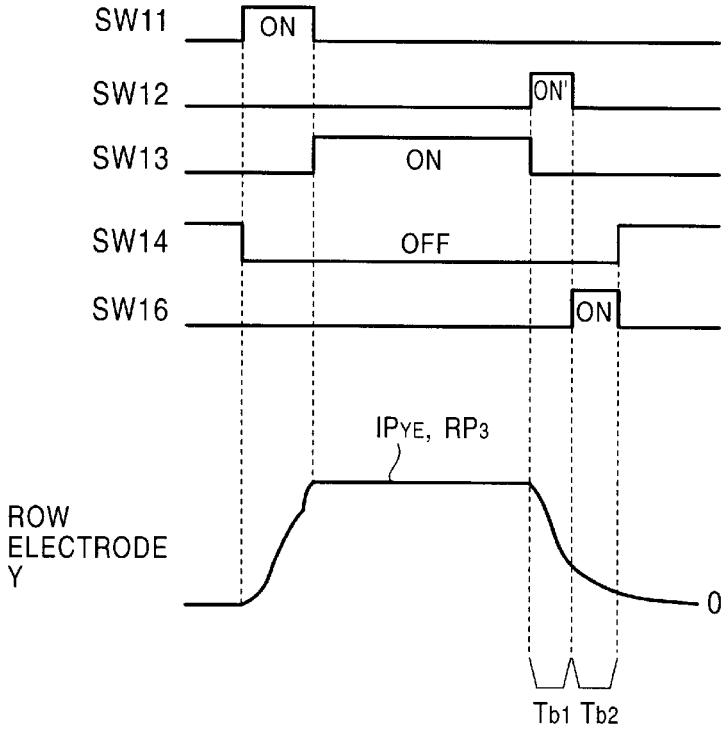

For example, as shown in FIGS. 10A and 10B, the period itself of the resistance trailing interval Tb2 of the sustaining pulse $IP_{YE}$ (or reset pulse $RP_{Y2}$) can be also adjusted in accordance with the panel temperature of the PDP 10, the accumulated display time, the magnitude of the light emission load, or the frequency of generation of the light-on state inversion detection signal. That is, when the sustaining pulse $IP_{YE}$ (or reset pulse $RP_{Y2}$) is formed in accordance with a switching sequence $SS_{YE}$ (or $SR_Y$) as shown in FIG. 7 (or FIG. 6), the drive controller 2' changes the period of time during which the switching signal SW16 is at the logic level "1". For example, when the panel temperature of the PDP 10 is high, or the accumulated display time is long, or the light emission load is large, or the frequency of generation of the light-on state inversion detection signal is high, the period of time during which the switching signal SW16 is at the logic level "1" is extended as shown in FIG. 10A, thereby extending the period of time of the resistance trailing interval Tb2. The discharge which is caused in the resistance trailing interval Tb2, thus, becomes weak and the amount of wall charges which are extinguished decreases. When the panel temperature of the PDP 10 is low, or the accumulated display time is short, or the light emission load is small, or the frequency of generation of the light-on state inversion detection signal is low, the period of time during which the switching signal SW16 is at the logic level "1" is shortened as shown in FIG. 10B, thereby shortening the period of time of the resistance trailing interval Tb2 as compared with that in FIG. 10A. The discharge which is caused in the resistance trailing interval Tb2, thus, becomes strong and the amount of wall charges which are extinguished increases.

Figure 11A:
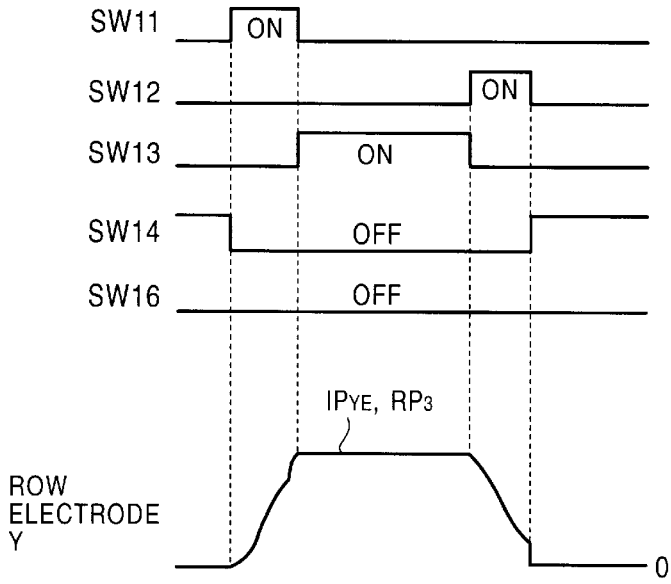
FIGS. 11A and 11B are diagrams showing examples of switching sequences at the time of changing a pulse width of the sustaining pulse $IP_{YE}$ or the third reset pulse $RP_3$ in the plasma display apparatus shown in FIG. 8.
Figure 11B:
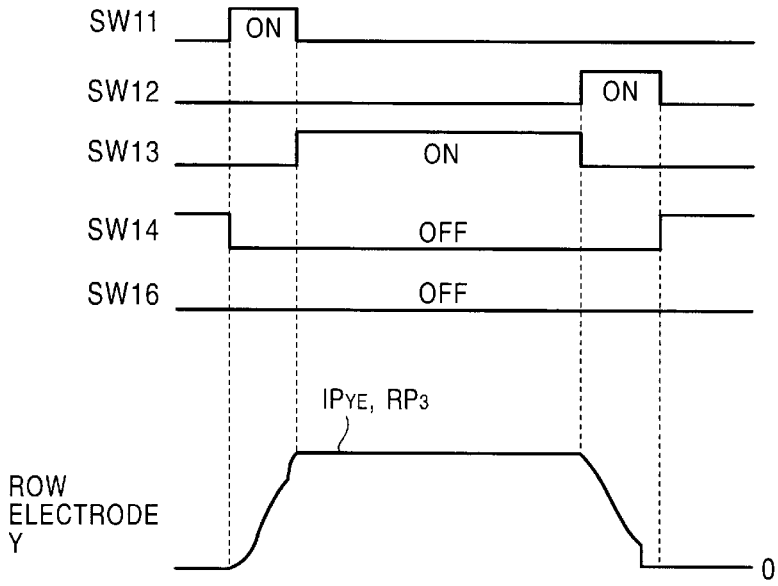

In place of changing the resistance trailing interval Tb2 of the sustaining pulse $IP_{YE}$ (or reset pulse $RP_{Y2}$), the pulse width itself of the sustaining pulse $IP_{YE}$ (or reset pulse $RP_{Y2}$) can be also changed. That is, when the sustaining pulse $IP_{YE}$ (or reset pulse $RP_{Y2}$) is formed in accordance with the switching sequence $SS_{YE}$ (or $SR_Y$) as shown in FIG. 7 (or FIG. 6), the drive controller 2' changes the period of time during which the switching signal SW13 is at the logic level "1". For example, when the panel temperature of the PDP 10 is low, or the accumulated display time is short, or the light emission load is small, or the frequency of generation of the light-on state inversion detection signal is low, the period of time during which the switching signal SW16 is at the logic level "1" is shortened as shown in FIG. 11A, thereby shortening the pulse width of the sustaining pulse $IP_{YE}$ (or reset pulse $RP_{Y2}$). On the contrary, when the panel temperature of the PDP 10 is high, or the accumulated display time is long, or the light emission load is large, or the frequency of generation of the light-on state inversion detection signal is high, the period of time during which the switching signal SW16 is at the logic level "1" is shortened as shown in FIG. 11B as compared with that in FIG. 11A. The pulse width of the sustaining pulse $IP_{YE}$ (or reset pulse $RP_{Y2}$) which is applied onto the row electrode, thus, becomes longer than that in FIG. 11A. That is, when the panel temperature of the PDP 10 is high, or the accumulated display time is long, or the light emission load is large, or the frequency of generation of the light-on state inversion detection signal is high, the time during which the voltage $V_s$ is applied continuously to the row electrode Y is extended as shown in FIG. 11B, thereby increasing the amount of wall charges which are formed.

It is also possible to execute both of the changing operation of the pulse width of the sustaining pulse $IP_{YE}$ (or reset pulse $RP_{Y2}$) and the changing operation of the change rate of the voltage value in the trailing interval as mentioned above.

Although the gradation driving method as shown in FIGS. 2 to 4 has been used as a gradation driving based on the subfield method in the embodiment, the gradation driving method to which the invention is applied is not limited to it.

In the embodiment, what is called a selective erasure address method whereby the wall charges are preliminarily formed in all of the discharge cells (all-resetting step Rc) and the wall charges in each discharge cell are selectively erased in accordance with the input video signal (addressing step Wc) is used as a subfield method. The invention, however, can be also similarly applied to the case where what is called a selective write address method whereby the wall charges in all of the discharge cells are preliminarily extinguished and the wall charges are selectively formed in each discharge cell in accordance with the input video signal is used as a subfield method.

According to the embodiment as described in detail above, the change rate of the voltage value in the trailing interval of each of the last reset pulse and sustaining pulse which is applied to cause the discharge at the end of each of the all-resetting step and the light emission sustaining step is set to be milder than that of the pulse which is applied just before it. With the above construction, the discharge which is caused in the trailing interval of each of the last reset pulse and sustaining pulse which is applied at the end of each of the all-resetting step and the light emission sustaining step is weakened. Even in the case where many wall charges are formed in the discharge cells due to an influence of the panel temperature, the magnitude of the light emission load, the aging change, or the like, therefore, the wall charges of only the proper amount can be extinguished by the discharge which is caused in the trailing interval. Since the amount of remaining wall charges can be adjusted to the proper amount just before the addressing step, therefore, the proper selective discharge corresponding to the input video signal is caused in the addressing step.

According to the invention, a preferable image display corresponding to the input video signal can be always performed irrespective of the panel temperature, the magnitude of the light emission load, the aging change, or the like.

Another embodiment of the invention will now be described in detail hereinbelow with reference to the drawings.

Figure 12:
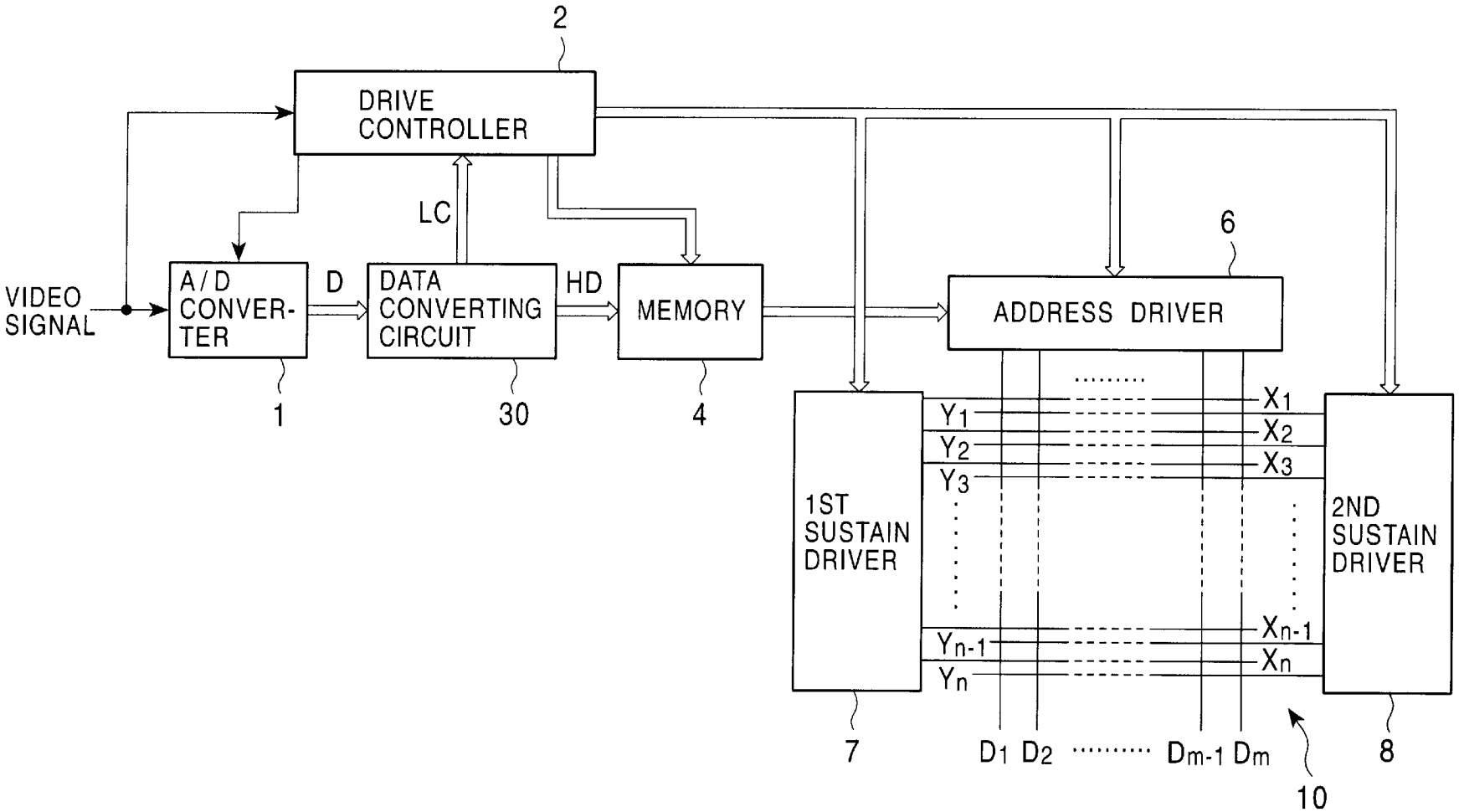
FIG. 12 is a diagram showing a schematic construction of a display apparatus to which another embodiment of a driving method of the invention is applied.

FIG. 12 shows a schematic construction of a display apparatus to which the driving method of the invention is applied.

As shown in FIG. 12, the display apparatus comprises: the A/D converter 1; the drive controller 2, a data converting circuit 30'; the memory 4; the PDP (plasma display panel) 10; the address driver 6; and the first and second sustain drivers 7 and 8. Since portions other than a portion regarding the data converting circuit 30' are substantially the same as those shown in FIG. 1, their overlapped descriptions are omitted here.

Figure 13:
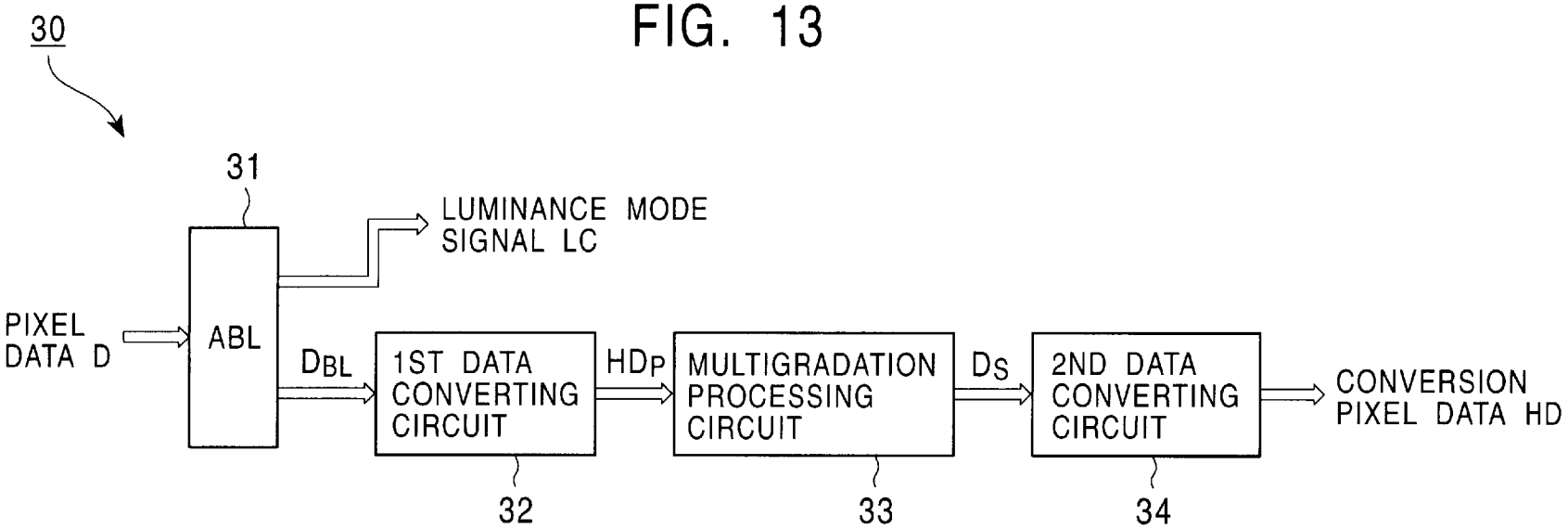
FIG. 13 is a diagram showing an internal construction of a data converting circuit 30'.

FIG. 13 shows an internal construction of the data converting circuit 30'. As shown in FIG. 13, the data converting circuit 30' comprises: an ABL (automatic luminance control) circuit 31; a first data converting circuit 32; a multigradation processing circuit 33; and a second data converting circuit 34.

The ABL circuit 31 adjusts a luminance level with respect to pixel data D of each pixel which is sequentially supplied from the A/D converter 1 in a manner such that an average luminance of an image which is displayed on the screen of the PDP 10 lies within a predetermined luminance range, and supplies obtained luminance adjustment pixel data $D_{BL}$ to the first data converting circuit 32.

The adjustment of the luminance level is performed before a ratio of the number of times of the light emission of the subfield is set to be nonlinear and an inverse gamma correction is made as mentioned above. The ABL circuit 31, therefore, is constructed in a manner such that the inverse gamma correction is executed to the pixel data (input pixel data) D and the luminance level of the pixel data D is adjusted automatically in accordance with the average luminance of the inverse gamma conversion pixel data obtained in this instance, thereby preventing the deterioration of the display quality due to the luminance adjustment.

Figure 14:
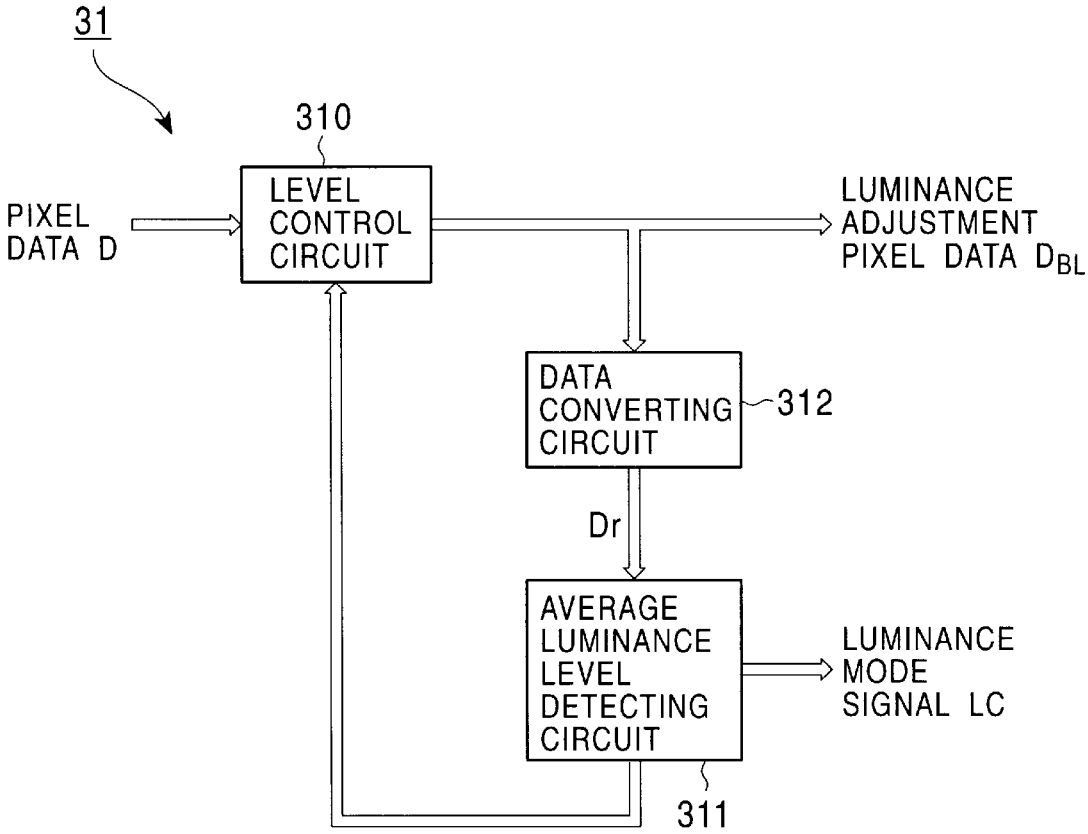
FIG. 14 is a diagram showing an internal construction of an ABL circuit 31.

FIG. 14 shows an internal construction of the ABL circuit 31.

Figure 15:
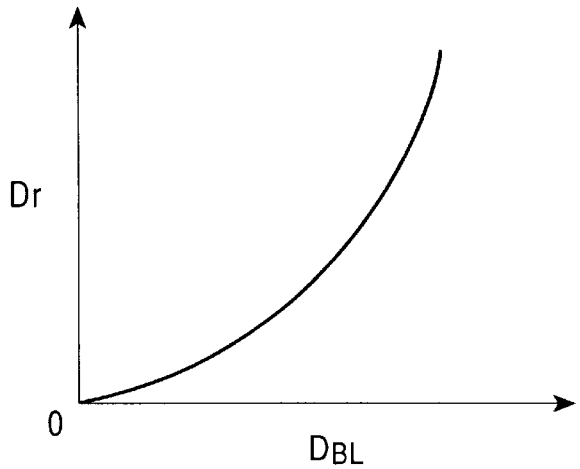
FIG. 15 is a diagram showing converting characteristics in a data converting circuit 312.

In FIG. 14, a level control circuit 310 generates the luminance adjustment pixel data $D_{BL}$ obtained by adjusting the level of the pixel data D in accordance with an average luminance derived by an average luminance level detecting circuit 311, which will be explained later. A data converting circuit 312 converts the luminance adjustment pixel data $D_{BL}$ on the basis of inverse gamma characteristics ($Y=X^{2.2}$) having nonlinear characteristics as shown in FIG. 15, and supplies obtained data as inverse gamma conversion pixel data Dr to the average luminance level detecting circuit 311. That is, the data converting circuit 312 performs the inverse gamma correction to the luminance adjustment pixel data $D_{BL}$, thereby reconstructing the pixel data (inverse gamma conversion pixel data Dr) corresponding to the original video signal from which the gamma correction has been cancelled.

In order to designate the light emitting period of time (the number of times of the light emission) in each subfield, the average luminance level detecting circuit 311 selects a luminance mode in which the PDP 10 can be light-emission driven at the luminance according to the average luminance obtained as mentioned above from, for example, first and second modes as shown in FIG. 16, and supplies a luminance mode signal LC indicative of the selected luminance mode to the drive controller 2. In this process, the drive controller 2 sets the period of time during which the light emission is maintained in the light emission sustaining step Ic of each of the subfields SF1 to SF14 shown in FIG. 3, that is, the number of sustaining pulses which are applied in each light emission sustaining step Ic in accordance with the ratio of the number of light emissions of each mode which has been designated by the luminance mode signal LC as shown in FIG. 16. That is, when the average luminance level of the input pixel data D is less than a predetermined value, the luminance mode is set to the first mode. When the average luminance level is equal to or larger than the predetermined value, the luminance mode is switched to the second mode in which the number of light emissions of each subfield is smaller than that in the first mode, so that the luminance is restricted automatically.

The average luminance level detecting circuit 311 obtains an average luminance from the inverse gamma conversion pixel data Dr and supplies it to the level control circuit 310.

Figure 17:
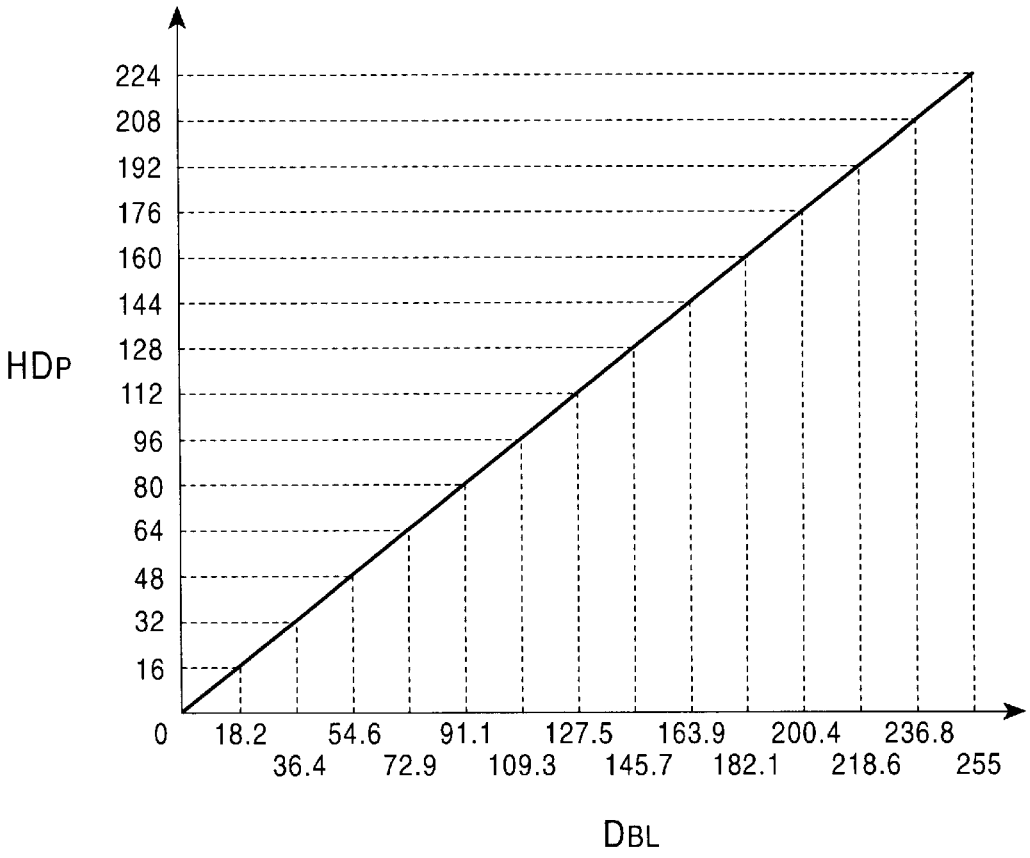
FIG. 17 is a diagram showing converting characteristics in a first data converting circuit 32.

The first data converting circuit 32 in FIG. 13 converts the luminance adjustment pixel data $D_{BL}$ of 256 gradations (8 bits) into conversion pixel data $HD_p$ of 8 bits (0 to 224) of 14×16/255 (224/255) on the basis of converting characteristics as shown in FIG. 17 and supplies it to the multigradation processing circuit 33. Specifically speaking, the luminance adjustment pixel data $D_{BL}$ of 8 bits (0 to 255) is converted in accordance with a conversion table based on the converting characteristics. That is, the converting characteristics are set in accordance with the number of bits of the input pixel data, the number of compression bits by the multigradation process, and the number of display gradations. In this manner, the first data converting circuit 32 is provided at the front stage of the multigradation processing circuit 33, which will be explained later, and the conversion according to the number of display gradations and the number of compression bits by the multigradation process is executed, thereby dividing the luminance adjustment pixel data $D_{BL}$ into an upper bit group (corresponding to the multigradation pixel data) and a lower bit group (data which is omitted: error data) at a bit boundary. The multigradation process is executed on the basis of that signal. The occurrence of luminance saturation by the multigradation process and the generation of a flat portion of the display characteristics (that is, generation of gradation distortion) which is caused in the case where the display gradation does not exist at the bit boundary can be, consequently, prevented.

Since the lower bit group is omitted, the number of gradations decreases. The decrease amount of the number of gradations can be obtained falsely by the operation of the multigradation processing circuit 33.

Applying timings (in one field) of the various driving pulses which are applied to the column electrode D and the row electrodes X and Y of the PDP 10 by the address driver 6 and the first and second sustain drivers 7 and 8 in accordance with various timing signals supplied from the drive controller 2 are as shown in FIG. 4.

After a predetermined amount of wall charges were formed in each discharge cell, the first sustain driver 7 applies the reset pulse $RP_{X2}$ of the positive polarity to the row electrodes $X_1$ to $X_n$ and, thereafter, the second sustain driver 8 applies the reset pulse $RP_{Y2}$ of the positive polarity to the row electrodes $Y_1$ to $Y_n$, respectively. As will be explained in detail later, in the trailing portion (rear edge portion) of the reset pulse $RP_{Y2}$, its pulse voltage has a undershoot part below 0 V as a ground potential.

As an explanation will be made later, in a trailing portion (rear edge portion) of a sustaining pulse $IP_{Yi}$ which is applied to the row electrodes $Y_1$ to $Y_n$ at the end of the light emission sustaining step Ic in each subfield, its pulse voltage has an undershoot part below 0 V that is taken as a ground potential.

FIG. 18 shows all patterns of the light emission driving which is executed on the basis of the light emission driving format as shown in FIG. 3.

With respect to the scanning pulses SP, the pulse width is more largely set in the subfield locating at a front position with regard to the time among the subfields SF1 to SF14. This is because when the sustain discharge light emission is sufficiently repeated in the light emitting state in the subfield locating before the subfield in which the selective erasing operation is executed (in the case of the high luminance), the sufficient priming particles exist in the discharge space and the selective erasure discharge is executed certainly. When the subfield which enters the light emitting state does not exist at the position before the subfield in which executing the selective erasing operation or the number of subfields which enter the light emitting state is small (that is, the low luminance state in which the selective erasure discharge is executed in the subfield SF1 or SF2), the number of the sustain discharge light emissions is small and sufficient priming particles do not exist in the discharge space. If the subfield of the selective erasure discharge comes in a state where the sufficient priming particles do not exist in the discharge space as mentioned above, a time lag occurs until the selective erasure discharge actually occurs after the scanning pulse SP has been applied, and the selective erasure discharge becomes unstable, so that the erroneous discharge occurs in the sustain discharge period of time and the display quality deteriorates. By setting the pulse width of the scanning pulse SP, therefore, to be larger in the subfield locating at a front position with regard to the time among the subfields SF1 to SF14, that is, by setting the pulse width of the scanning pulse SP in the head subfield SF1 (subfield of the first group) in one field period of time to be larger than that of the scanning pulse SP in each of the subfield SF2 (subfield of the second group) subsequent to the subfield SF1, the subfield SF3 (subfield of the third group), . . . , and the subfield SF14 (subfield of the 14th group), the selective erasure discharge can certainly occur during the application of the scanning pulses SP. The stability of the selective erasing operation can be assured.

The pulse width of the scanning pulse SP in each same subfield in the second mode is set to be larger than that in the first mode. This is because, as mentioned above, in the case where one of the first and second modes is selected in accordance with the average luminance level of the input pixel data D, the number of light emissions (the number of sustaining pulses) during the sustain discharge period of time in each of the same subfields is changed, and the luminance control is performed, if the average luminance level of the input pixel data D is equal to or larger than a predetermined value, the luminance mode is switched to the second mode. In the second mode, as shown in FIG. 18, since the number of times of the sustain discharge light emission in each of the same subfields decreases as compared with that in the first mode, the number of priming particles which are excited in the discharge space by the sustain discharge light emission decreases as compared with that in the first mode. The selective erasure discharge in the pixel data writing step becomes unstable, so that the erroneous discharge occurs during the sustain discharge period of time and the display quality deteriorates. By setting the pulse width of the scanning pulse SP of each subfield in the second mode to be longer than that in the first mode (that is, a scan rate of the scanning pulse SP becomes long), the selective erasure discharge certainly occurs during the applying period of time of the scanning pulses, thereby assuring the stability of the selective erasing operation.

In accordance with the conversion table as shown in FIG. 2, the second data converting circuit 34 converts multigradation pixel data $D_S$ into conversion pixel data (display pixel data) HD comprising the 1st to 14th bits corresponding to the subfields SF1 to SF14. The multigradation pixel data $D_s$ is obtained by converting the input pixel data D of 8 bits (256 gradations) into the data of 224/225 in accordance with the first data conversion and, further, converting it into the data of total 4 bits (15 gradations) by respectively compressing it by an amount of 2 bits by, for example, an error diffusing process and a multigradation process such as a dither process.

Figure 19:
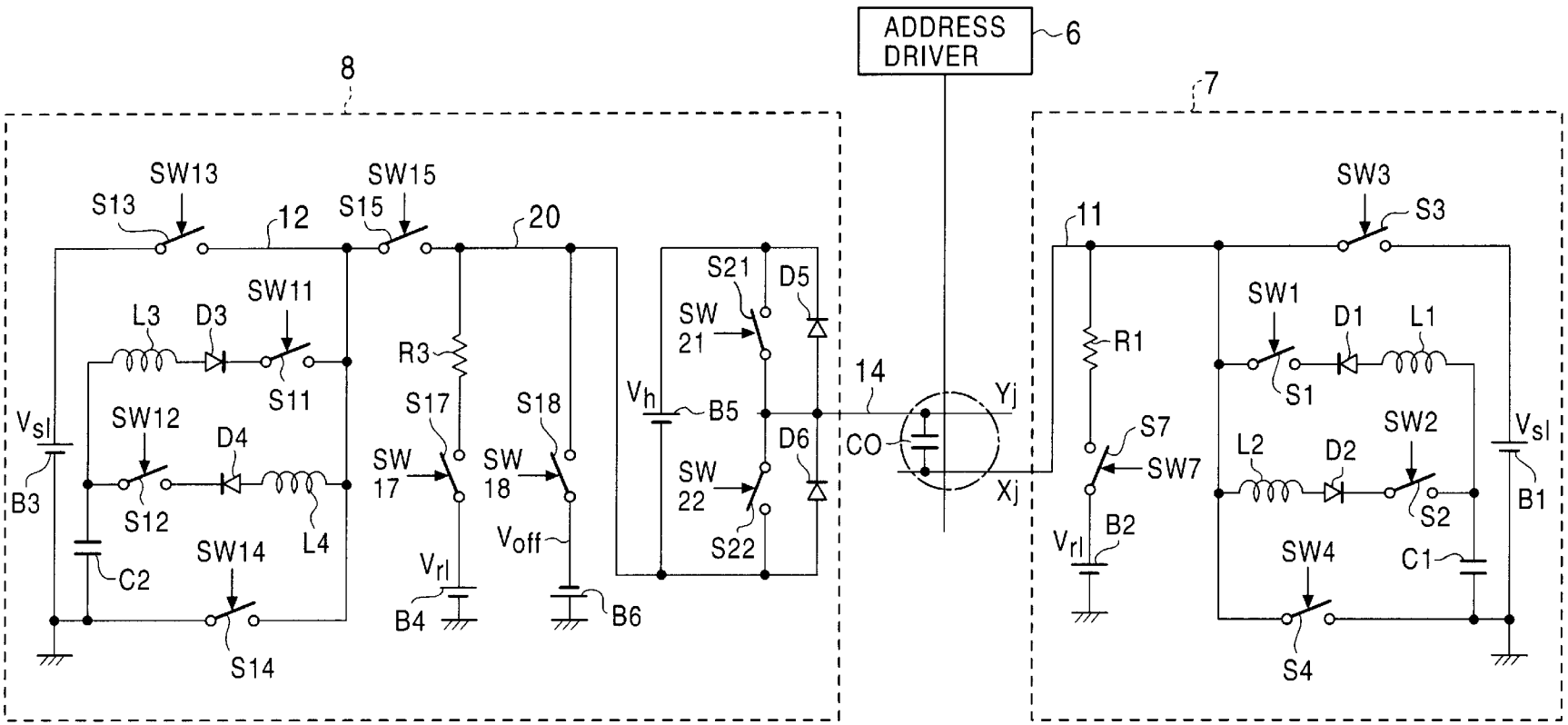
FIG. 19 is a circuit diagram showing specific constructions of first and second sustain drivers.

FIG. 19 shows specific constructions of the first and second sustain drivers 7 and 8 with respect to electrodes $X_j$ and $Y_j$. The electrode $X_j$ is the electrode of the jth row among the electrodes $X_1$ to $X_n$. The electrode $Y_j$ is the electrode of the jth row among the electrodes $Y_1$ to $Y_n$. A portion between the electrodes $X_j$ and $Y_j$ functions as a capacitor $C_O$ .

The two power sources B1 and B2 are provided for the first sustain driver 7. The power source B1 generates a voltage $V_{s1}$ (for example, 170 V) and the power source B2 generates a voltage $V_{r1}$ (for example, 190 V). A positive terminal of the power source B1 is connected to a connecting line 11 to the electrode $X_j$ via the switching device S3 and a negative terminal is connected to the ground. The switching device S4 is connected between the connecting line 11 and the ground. A serial circuit comprising the switching device S1, diode D1, and coil L1 and a serial circuit comprising the coil L2, diode D2, and switching device S2 are connected to the ground side via the capacitor C1 in common. The diode D1 is connected in a manner such that the capacitor C1 side is set to an anode. The diode D2 is connected in a manner such that the capacitor C1 side is set to a cathode. A positive terminal of the power source B2 is connected to the connecting line 11 via the switching device S7 and the resistor R1 and a negative terminal is connected to the ground.

Four power sources B3 to B6 are provided for the second sustain driver 8. The power source B3 generates the voltage $V_{s1}$ (for example, 170 V), the power source B4 generates the voltage $V_{r1}$ (for example, 190 V), the power source B6 generates a voltage $V_{off}$ (for example, 140 V), and the power source B5 generates the voltage $V_h$ (for example, 160 V: $V_h > V_{off}$). A positive terminal of the power source B3 is connected to the connecting line 12 to the switching device S15 via the switching device S13 and a negative terminal is connected to the ground. The switching device S14 is connected between the connecting line 12 and the ground. A serial circuit comprising the switching device S11, diode D3, and coil L4 and a serial circuit comprising the coil L4, diode D4, and switching device S12 are connected to the ground side via the capacitor C2 in common. The diode D3 is connected in a manner such that the capacitor C2 side is set to an anode. The diode D4 is connected in a manner such that the capacitor C2 side is set to a cathode.

The connecting line 12 is connected to the connecting line 20 to a negative terminal of the power source B5 via the switching device S15. A negative terminal of the power source B4 and a positive terminal of the power source B6 are connected to the ground. A positive terminal of the power source B4 is connected to the connecting line 20 via the switching device S17 and the resistor R3. A negative terminal of the power source B6 is connected to the connecting line 20 via the switching device S18.

A positive terminal of the power source B5 is connected to a connecting line 14 to the electrode $Y_j$ via the switching device S21. A negative terminal of the power source B5 connected to the connecting line 20 is connected to the connecting line 14 via the switching device S22. The diode D5 is connected to the switching device S21 in parallel. The diode D6 is connected to the switching device S22 in parallel. The diode D5 is connected in a manner such that the connecting line 14 side is set to an anode. The diode D6 is connected in a manner such that the connecting line 14 side is set to a cathode.

The on/off operations of the switching devices S1 to S4, S7, S11 to S17, S21, and S22 are controlled by the drive controller 2. An arrow of each switching device indicates a control signal terminal from the drive controller 2.

In the second sustain driver 8, the power source B3, switching devices S11 to S15, coils L3 and L4, diodes D3 and D4, and capacitor C2 construct a sustain driver unit. The power source B4, resistor R3, and switching device S17 construct a reset driver unit. The residual power sources B5 and B6, switching devices S13, S18, S21, and S22, and diodes D5 and D6 construct a scan driver unit.

Figure 20:
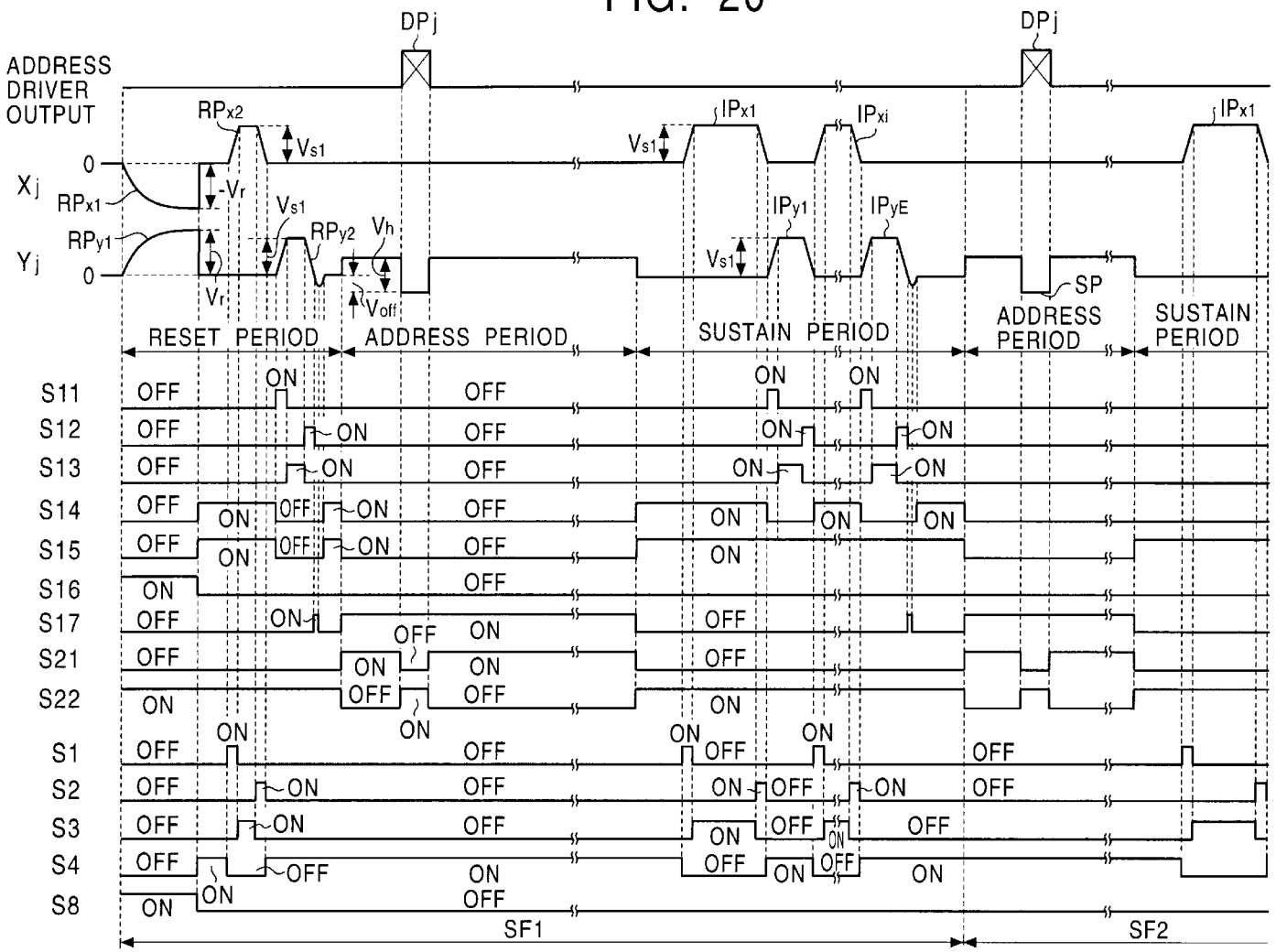
FIG. 20 is a time chart of each unit in the circuit in FIG. 19.

Subsequently, the operation of the display apparatus with the above construction will be described with reference to a timing chart of FIG. 20. The timing chart of FIG. 20 shows only the first subfield SF1 and a part of the second subfield subsequent thereto. The operation of the display apparatus comprises a reset period of time (resetting step), an address period of time (pixel data writing step), and a sustain period of time (light emission sustaining step).

First, when a reset period of time comes, the switching device S8 of the first sustain driver 7 is turned on and both of the switching devices S17 and S22 of the second sustain driver 8 are turned on. Other switching devices are OFF. By the turn-on of the switching devices S17 and S22, a current flows into the electrode $Y_j$ from the positive terminal of the power source B4 via the switching device S17, resistor R3, and switching device S22. By the turn-on of the switching device S8, a current flows into the positive terminal of the power source B2 from the electrode $X_j$ via the resistor R1 and switching device S7. The electric potential of the electrode $X_j$ gradually decreases due to a time constant of the capacitor $C_O$ and resistor R1 and becomes the reset pulse $RP_{X1}$. The electric potential of the electrode $Y_j$ gradually rises due to a time constant of the capacitor $C_O$ and resistor R2 and becomes the reset pulse $RP_{Y1}$. The reset pulse $RP_{X1}$ becomes finally the voltage $-V_{r1}$. The reset pulse $RP_{Y1}$ becomes finally the voltage $V_{r1}$. The reset pulse $RP_{X1}$ is simultaneously applied to all of the electrodes $X_1$ to $X_n$. The reset pulse $RP_{Y1}$ is formed for each electrodes $Y_1$ to $Y_n$ and also simultaneously applied to all of the electrodes $Y_1$ to $Y_n$.

By the simultaneous application of the reset pulses $RP_{X1}$ and $RP_{Y1}$, all of the discharge cells of the PDP 10 are discharge excited and charged particles are generated. After the termination of the discharge, a predetermined amount of wall charges are uniformly formed in dielectric layers of all discharge cells.

After the levels of the reset pulses $RP_{X1}$ and $RP_{Y1}$ were saturated, the switching devices S7 and S17 are turned off. At this point of time, the switching devices S4, S14, and S15 are turned on and both of the electrodes $X_j$ and $Y_j$ are connected to the ground. The reset pulses $RP_{X1}$ and $RP_{Y1}$ are, thus, extinguished.

After the extinction of the reset pulses $RP_{X1}$ and $RP_{Y1}$, in the first sustain driver 7, the electric potential of the electrode $X_j$ is set to the ground potential of almost 0 V by the turn-on of the switching device S4. When the switching device S4 is inverted from ON to OFF and the switching device S1 is turned on, the current reaches the electrode $X_j$ via the coil L1, diode D1, and switching device S1 by the charges stored in the capacitor C1 and flows into the capacitor $C_O$, thereby charging the capacitor $C_O$. In this process, the electric potential of the electrode $X_j$ rises gradually as shown in FIG. 20 by the time constant of the coil L1 and capacitor $C_O$.

Subsequently, the switching device S1 is turned off and the switching device S3 is turned on. The electric potential $V_{S1}$ at the positive terminal of the power source B1 is, thus, applied to the electrode $X_j$. After that, the switching device S3 is turned off and the switching device S2 is turned on. The current flows from the electrode $X_j$ into the capacitor C1 via the coil L2, diode D2, and switching device S2 by the charges accumulated in the capacitor $C_O$. In this process, the electric potential of the electrode $X_j$ gradually decreases as shown in FIG. 20 by the time constant of the coil L2 and capacitor C1. When the electric potential of the electrode $X_j$ reaches almost 0 V, the switching device S2 is turned off and the switching device S4 is turned on.

By the above operation, the first sustain driver 7 applies the reset pulse $RP_{X2}$ of the positive voltage as shown in FIG. 20 to the electrode $X_j$.

In the second sustain driver 8, after the time point of the turn-on of the switching device S4 when the reset pulse $RP_{X2}$ is extinguished, the switching device S11 is turned on and the switching device S14 is turned off. When the switching device S14 is ON, although the electric potential of the electrode $Y_j$ is equal to the ground potential of almost 0V, when the switching device S14 is turned off and the switching device S11 is turned on, the current reaches the electrode $Y_j$ via the coil L3, diode D3, and switching devices S11, S15, and S22 by the charges accumulated in the capacitor C2 and flows into the capacitor $C_O$, thereby charging the capacitor $C_O$. In this process, the electric potential of the electrode $Y_j$ gradually rises as shown in FIG. 20 by the time constant of the coil L3 and capacitor $C_O$.

Subsequently, the switching device S11 is turned off and the switching device S13 is turned on. The electric potential $V_{S1}$ at the positive terminal of the power source B3 is, thus, applied to the electrode $Y_j$ via the switching devices S13, S15, and S22. After that, the switching device S13 is turned off and the switching device S12 is turned on. The current flows from the electrode $Y_j$ into the capacitor C2 via the switching devices S22 and S15, coil L4, diode D4, and switching device S12 by the charges accumulated in the capacitor $C_O$. In this process, the electric potential of the electrode $Y_j$ gradually decreases as shown in FIG. 20 by the time constant of the coil L4 and capacitor C2. When the electric potential of the electrode $Y_j$ reaches almost 0V, the switching device S18 is turned on only for a short time and is returned to the OFF state. The electric potential of the electrode $Y_j$ is once undershoot below 0 V as shown in FIG. 20 due to the effect of an electric potential $-V_{off}$ at the negative terminal of the power source B6 and returns to 0 V. Both of the switching devices S14 and S15 are turned on.

By the above operation, the second sustain driver 8 applies the reset pulse $RP_{Y2}$ of the positive voltage as shown in FIG. 20 to the electrode $Y_j$. An undershoot below 0 V occurs in the trailing portion of the reset pulse $RP_{Y2}$.

After that, the switching devices S14 and S15 are turned off and the reset period of time is finished.

Subsequently, when the address period of time is started, the switching device S22 is turned off, the switching device S18 is turned on, and at the same time, the switching device S21 is turned on. Since the circuit enters a state where the power sources B6 and B5 are serially connected, the electric potential at the positive terminal of the power source B5 is set to $V_h-V_{off}$. The positive electric potential is applied to the electrode $Y_j$ via the switching device S21.

During the address period of time, the address driver 6 converts the pixel data of each pixel based on the video signal into pixel data pulses $DP_1$ to $DP_n$ having a voltage value according to its logic level and sequentially applies them to the column electrodes $D_1$ to $D_m$ for each row. As shown in FIG. 20, a pixel data pulse $DP_j$ is applied to the electrode $Y_j$.

The second sustain driver 8 sequentially applies the scanning pulses SP of the negative voltage to the row electrodes $Y_1$ to $Y_n$ synchronously with the timing of each of the pixel data pulses $DP_1$ to $DP_n$, respectively. Synchronously with the application of the pixel data pulse $DP_j$ from the address driver 6, the switching device S21 is turned off and the switching device S22 is turned on. The negative electric potential $-V_{off}$ at the negative terminal of the power source B6 is applied as a scanning pulse SP to the electrode $Y_j$ via the switching devices S18 and S22. Synchronously with the stop of the application of the pixel data pulse $DP_j$ from the address driver 6, the switching device S21 is turned on and the switching device S22 is turned off. The electric potential $V_h-V_{off}$ at the positive terminal of the power source B5 is applied to the electrode $Y_j$ via the switching device S21. After that, also with respect to an electrode $Y_{j+1}$, in a manner similar to the case of the electrode $Y_j$ shown in FIG. 20, the scanning pulse SP is applied synchronously with the application of a pixel data pulse $DP_{j+1}$ from the address driver 6.

Among the discharge cells belonging to the row electrode to which the scanning pulse SP has been applied, a discharge is caused in the discharge cells to which the pixel data pulses of the positive voltage have been further simultaneously applied, and most of the wall charges are lost. Since no discharge is caused in the discharge cells to which the pixel data pulses of the positive voltage are not applied although the scanning pulse SP has been applied, the wall charges remain. In this process, the discharge cells in which the wall charges remain become the light emission discharge cells. The discharge cells in which the wall charges have been extinguished become the non-light emission discharge cells.

When the operating period is switched from the address period to the sustain period, the switching devices S17 and S21 are turned off. In place of them, the switching devices S14, S15, and S22 are turned on. The ON state of the switching device S4 is sustained.

During the sustain period of time, in the first sustain driver 7, the electric potential of the electrode $X_j$ is set to the ground potential of almost 0 V by the turn-on of the switching device S4. Subsequently, when the switching device S4 is turned off and the switching device S1 is turned on, the current reaches the electrode $X_j$ via the coil L1, diode D1, and switching device S1 by the charges stored in the capacitor C1 and flows into the capacitor C0, thereby charging the capacitor C0. In this process, the electric potential of the electrode $X_j$ rises gradually as shown in FIG. 20 by the time constant of the coil L1 and capacitor C0.

Subsequently, the switching device S1 is turned off and the switching device S3 is turned on. The electric potential $V_{S1}$ at the positive terminal of the power source B1 is, thus, applied to the electrode $X_j$. After that, the switching device S3 is turned off and the switching device S2 is turned on. The current flows from the electrode $X_j$ into the capacitor C1 via the coil L2, diode D2, and switching device S2 by the charges accumulated in the capacitor C0. In this process, the electric potential of the electrode $X_j$ gradually decreases as shown in FIG. 20 by the time constant of the coil L2 and capacitor C1. When the electric potential of the electrode $X_j$ reaches almost 0 V, the switching device S2 is turned off and the switching device S4 is turned on.

By the above operation, the first sustain driver 7 applies sustaining pulses $IP_{X1}$ (first sustaining pulses) of the positive voltage as shown in FIG. 20 to the electrode $X_j$.

In the second sustain driver 8, simultaneously with the time point of the turn-on of the switching device S4 when the sustaining pulses $IP_{X1}$ are extinguished, the switching device S11 is turned on and the switching device S14 is turned off. When the switching device S14 is ON, although the electric potential of the electrode $Y_j$ is equal to the ground potential of almost 0 V, when the switching device S14 is turned off and the switching device S11 is turned on, the current reaches the electrode $Y_j$ via the coil L3, diode D3, and switching devices S11, S15, and S22 by the charges accumulated in the capacitor C2 and flows into the capacitor C0, thereby charging the capacitor C0. In this process, the electric potential of the electrode $Y_j$ gradually rises as shown in FIG. 20 by the time constant of the coil L3 and capacitor C0.

Subsequently, the switching device S11 is turned off and the switching device S13 is turned on. The electric potential $V_{S1}$ at the positive terminal of the power source B3 is, thus, applied to the electrode $Y_j$ via the switching devices S13, S15, and S22. After that, the switching device S13 is turned off and the switching device S12 is turned on. The current flows from the electrode $Y_j$ into the capacitor C2 via the switching devices S22 and S15, coil L4, diode D4, and switching device S12 by the charges accumulated in the capacitor C0. In this process, the electric potential of the electrode $Y_j$ gradually decreases as shown in FIG. 20 by the time constant of the coil L4 and capacitor C2. When the electric potential of the electrode $Y_j$ reaches almost 0 V, the switching device S12 is turned off and the switching device S14 is turned on.

By the above operation, the second sustain driver 8 applies the sustaining pulses $IP_{Y1}$ of the positive voltage as shown in FIG. 20 to the electrode $Y_j$.

In a remaining portion of the sustain period of time after the sustaining pulses $IP_{Y1}$ were applied to the electrode $Y_j$, sustaining pulses $IP_{X2}$ to $IP_{Xi}$ and sustaining pulses $IP_{Y2}$ to $IP_{YE}$ are alternately formed and alternately applied to the electrodes $X_j$ and $Y_j$, respectively. The light emission discharge cells in which the wall charges remain, therefore, repeat the discharge light emission and maintains the light emitting state.

With respect to the sustaining pulse $IP_{YE}$ which is applied to the electrodes $Y_j$ at the end of the sustain period of time, an undershoot occurs in a manner similar to the reset pulse $RP_{Y2}$ mentioned above. That is, in the trailing portion of the sustaining pulse $IP_{YE}$, when the electric potential of the electrode $Y_j$ reaches almost 0 V, the switching device S18 is turned off only for a short time and returned to the OFF state. The electric potential of the electrode $Y_j$ is, therefore, undershooted below 0 V as shown in FIG. 19 due to the effect of the electric potential $-V_{off}$ at the negative terminal of the power source B6 and returned to 0 V. Both of the switching devices S14 and S15 are turned on. The sustaining pulse $IP_{YE}$ of the positive voltage as shown in FIG. 20 is, thus, applied to the electrode $Y_j$. In the trailing portion of the sustaining pulse $IP_{YE}$, an undershoot below 0 V occurs.

The timings of application of the sustaining pulses $IP_{X1}$ to $IP_{xi}$ to the electrode $X_j$ are not limited to the electrode $X_j$ but they are simultaneously applied to all of the row electrodes $X_1$ to $X_n$. The timings of application of the sustaining pulses $IP_{Y1}$ to $IP_{YE}$ to the electrode $Y_j$ are not limited to the electrode $Y_j$ but they are simultaneously applied to all of the row electrodes $Y_1$ to $Y_n$.

As mentioned above, by undershooting the trailing portion of each of the reset pulse $RP_{Y2}$ and sustaining pulse $IP_{YE}$ which are applied to the electrodes $Y_1$ to $Y_n$ just before the pixel data writing step as an address period of time as mentioned above, an amount of wall charges is adjusted. That is, since the amount of wall charges in the electrodes $Y_1$ to $Y_n$ is reduced by the trailing discharge, according to the selective erasure address method, a possibility that an erroneous discharge occurs in the discharge cell decreases even if the amplitude voltage value of the scanning pulse SP is raised.

A magnitude of the undershoot in the trailing portion of each of the reset pulse $RP_{Y2}$ and sustaining pulse $IP_{YE}$ can also be changed in accordance with the amplitude voltage value of the scanning pulse SP. That is, if the voltage value of the scanning pulse SP is set to a relatively small value, by reducing the undershoot amount, the trailing discharge is relatively weakened, so that a decrease amount of the wall charges in the row electrodes $Y_1$ to $Y_n$ by the leading discharge can be reduced. When the voltage value of the scanning pulse SP is set to a relatively large value, by increasing the amount of undershoot, the trailing discharge is relatively enhanced, the amount of the decrease of wall charges in the row electrodes $Y_1$ to $Y_n$ by the leading discharge can be increased. Therefore, if the amount of undershoot is increased and the trailing discharge is relatively enhanced, the amount of wall charges in the row electrodes $Y_1$ to $Y_n$ decreases. The erroneous discharge due to the application of the scanning pulses SP is prevented.

In the embodiment mentioned above, the first sustaining pulse $IP_{X1}$ which is formed for the first time during the sustain period of time of each subfield has a pulse width larger than those of the sustaining pulses $IP_{X2}$ to $IP_{Xi}$ and $IP_{Y1}$ to $IP_{YE}$ which are formed after that.

Although the example in which the invention has been applied to 1-reset 1-selective erasure address method has been shown in each of the above embodiments, the invention is not limited to it. For example, the invention can be also applied to the conventional gradation display in which a $2^N$-gradation display is performed by N subfields. The invention can be also applied to the case of a selective write address method whereby wall charges are selectively formed in each discharge cell in accordance with the pixel data pulse in the pixel data writing step.

As mentioned above, according to the invention, since the proper selective discharge is performed while preventing the erroneous discharge of the discharge cells in the pixel data writing step, the image display of high quality can be performed.

This application is based on Japanese Patent Applications Nos. 2001-160542 and 2001-194800 which are herein incorporated by reference.

What is claimed is:

1. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

a resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state:

an addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state; and a light emission sustaining part for applying sustaining pulses to each of said row electrode pairs in each of said subfields a number of times corresponding to said subfields, thereby allowing only said discharge cells in said light-on discharge cell state to repetitively execute a sustain-discharge, wherein a change rate of a voltage value in a trailing interval of the last sustaining pulse in each of said sustaining pulses is milder than that of a voltage value in a trailing interval of at least the sustaining pulse just before the last sustaining pulse.

2. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

a resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

an addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state; and a light emission sustaining part for applying sustaining pulses to each of said row electrode pairs in each of said subfields a number of times corresponding to said subfields, thereby allowing only said discharge cells in said light-on discharge cell state to repetitively execute a sustain-discharge, wherein a change rate of a voltage value in a trailing interval of the last reset pulse in each of said reset pulses is milder than that of a voltage value in a trailing interval of at least the reset pulse just before the last reset pulse.

3. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

a resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

an addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

a light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and a temperature detecting part for detecting a panel temperature of said plasma display panel, wherein said light emission sustaining part changes a change rate of a voltage value in a trailing interval of the last sustaining pulse in each of said sustaining pulses in accordance with said panel temperature.

4. An apparatus according to claim 3, wherein when said panel temperature is high, said light emission sustaining part sets the change rate of the voltage value in the trailing interval of said last sustaining pulse to be milder than that in the case where said panel temperature is low.

5. An apparatus according to claim 3, wherein said light emission sustaining part changes a pulse width of said last sustaining pulse in accordance with said panel temperature.

6. An apparatus according to claim 5, wherein when said panel temperature is high, said light emission sustaining part sets the pulse width of said last sustaining pulse to be longer than that in the case where said panel temperature is low.

7. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and temperature detecting part for detecting a panel temperature of said plasma display panel, wherein said reset part changes a change rate of a voltage value in a trailing interval of the last reset pulse in each of said reset pulses in accordance with said panel temperature.

8. An apparatus according to claim 7, wherein when said panel temperature is high, said reset part sets the change rate of the voltage value in the trailing interval of said last reset pulse to be milder than that in the case where said panel temperature is low.

9. An apparatus according to claim 7, wherein said reset part changes a pulse width of said last reset pulse in accordance with said panel temperature.

10. An apparatus according to claim 9, wherein when said panel temperature is high, said reset part sets the pulse width of said last reset pulse to be longer than that in the case where said panel temperature is low.

11. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and a timer for counting an accumulated display time of said plasma display panel, wherein said light emission sustaining part changes a change rate of a voltage value in a trailing interval of the last sustaining pulse in each of said sustaining pulses in accordance with said accumulated display time.

12. An apparatus according to claim 11, wherein when said accumulated display time is long, said light emission sustaining part sets the change rate of the voltage value in the trailing interval of said last sustaining pulse to be milder than that in the case where said accumulated display time is short.

13. An apparatus according to claim 11, wherein said light emission sustaining part changes a pulse width of said last sustaining pulse in accordance with said accumulated display time.

14. An apparatus according to claim 13, wherein when said accumulated display time is long, said light emission sustaining part sets the pulse width of said last sustaining pulse to be longer than that in the case where said accumulated display time is short.

15. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and a timer for counting an accumulated display time of said plasma display panel, wherein said reset part changes a change rate of a voltage value in a trailing interval of the last reset pulse among said reset pulses in accordance with said accumulated display time.

16. An apparatus according to claim 15, wherein when said accumulated display time is long, said reset part sets the change rate of the voltage value in the trailing interval of said last reset pulse to be milder than that in the case where said accumulated display time is short.

17. An apparatus according to claim 15, wherein said reset part changes a pulse width of said last reset pulse in accordance with said accumulated display time.

18. An apparatus according to claim 17, wherein when said accumulated display time is long, said reset part sets the pulse width of said last reset pulse to be longer than that in the case where said accumulated display time is short.

19. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and light emission load measuring part for obtaining a number of said discharge cells in which said sustain-discharge is caused for each said subfield and measuring a magnitude of a light emission load on the basis of the obtained number of said discharge cells, wherein said light emission sustaining part changes a change rate of a voltage value in a trailing interval of the last sustaining pulse among said sustaining pulses in accordance with the magnitude of said light emission load.

20. An apparatus according to claim 19, wherein when said light emission load is large, said light emission sustaining part sets the change rate of the voltage value in the trailing interval of said last sustaining pulse to be milder than that in the case where said light emission load is small.

21. An apparatus according to claim 19, wherein said light emission sustaining part changes a pulse width of said last sustaining pulse in accordance with the magnitude of said light emission load.

22. An apparatus according to claim 21, wherein when said light emission load is large, said light emission sustaining part sets the pulse width of said last sustaining pulse to be longer than that in the case where said light emission load is small.

23. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and light emission load measuring part for obtaining a number of said discharge cells in which said sustain discharge is caused for each said subfield and measuring a magnitude of a light emission load on the basis of the obtained number of said discharge cells, wherein said reset part changes a change rate of a voltage value in a trailing interval of the last reset pulse among said reset pulses in accordance with the magnitude of said light emission load.

24. An apparatus according to claim 23, wherein when said light emission load is large, said reset part sets the change rate of the voltage value in the trailing interval of said last reset pulse to be milder than that in the case where said light emission load is small.

25. An apparatus according to claim 23, wherein said reset part changes a pulse width of said last reset pulse in accordance with the magnitude of said light emission load.

26. An apparatus according to claim 25, wherein when said light emission load is large, said reset part sets the pulse width of said last reset pulse to be longer than that in the case where said light emission load is small.

27. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constructing one field display period of time of a video signal, comprising:

resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and light-on state inversion detecting part for detecting said discharge cell which continuously enters said light-on discharge cell state for a predetermined time and generating a light-on state inversion signal when said discharge cell formed at a position adjacent to said detected discharge cell is shifted from said light-off discharge cell state to said light-on discharge cell state, wherein said light emission sustaining part changes a change rate of a voltage value in a trailing interval of the last sustaining pulse in each of said sustaining pulses in accordance with a frequency of generation of said light-on state inversion signal.

28. An apparatus according to claim 27, wherein when the frequency of generation of said light-on state inversion signal is high, said light emission sustaining part sets the change rate of the voltage value in the trailing interval of said last sustaining pulse to be milder than that in the case where the frequency of generation of said light-on state inversion signal is low.

29. An apparatus according to claim 27, wherein said light emission sustaining part changes a pulse width of said last sustaining pulse in accordance with the frequency of generation of said light-on state inversion signal.

30. An apparatus according to claim 29, wherein when the frequency of generation of said light-on state inversion signal is high, said light emission sustaining part sets the pulse width of said last sustaining pulse to be longer than that in the case where the frequency of generation of said light-on state inversion signal is low.

31. A driving apparatus of a plasma display panel which has a plurality of row electrode pairs corresponding to display lines and a plurality of column electrodes arranged so as to cross each of said row electrode pairs and in which a discharge cell serving as a pixel is formed in each intersecting portion of said row electrode pairs and said column electrodes and which is driven for each of a plurality of subfields constituting one field display period of time of a video signal, comprising:

resetting part for repetitively applying reset pulses to all of said row electrode pairs in at least one of said subfields and allowing all of said discharge cells to repetitively reset-discharge, thereby initializing each of said discharge cells into either a light-on discharge cell state or a light-off discharge cell state;

addressing part for applying scanning pulses to one of each of said row electrode pairs in each of said subfields and applying pixel data pulses corresponding to said video signal to said column electrodes, thereby allowing each of said discharge cells to selectively discharge, and setting said discharge cells to either said light-on discharge cell state or said light-off discharge cell state;

light emission sustaining part for applying sustaining pulses to each of said row electrode pairs in each of said subfields a number of times corresponding to said subfields, thereby allowing only said discharge cells in said light-on discharge cell state to repetitively execute a sustain-discharge; and light-on state inversion detecting part for detecting said discharge cell which continuously enters said light-on discharge cell state for a predetermined time and generating a light-on state inversion signal when said discharge cell formed at a position adjacent to said detected discharge cell is shifted from said light-off discharge cell state to said light-on discharge cell state, wherein said reset part changes a change rate of a voltage value in a trailing interval of the last reset pulse among said reset pulses in accordance with a frequency of generation of said light-on state inversion signal.

32. An apparatus according to claim 31, wherein when the frequency of generation of said light-on state inversion signal is high, said reset part sets the change rate of the voltage value in the trailing interval of said last reset pulse to be milder than that in the case where the frequency of generation of said light-on state inversion signal is low.

33. An apparatus according to claim 31, wherein said reset part changes a pulse width of said last reset pulse in accordance with the frequency of generation of said light-on state inversion signal.

34. An apparatus according to claim 33, wherein when the frequency of generation of said light-on state inversion signal is high, said reset part sets the pulse width of said last reset pulse to be longer than that in the case where the frequency of generation of said light-on state inversion signal is low.

35. A driving method for a gradation driving of a plasma display panel in accordance with a video signal, said plasma display panel having a plurality of row electrode pairs having a capacitive load between the pairs and a plurality of column electrodes which are arranged so as to cross said row electrode pairs and form a discharge cell in each intersecting portion, wherein a display period of one field in said video signal is made up of a plurality of subfields, and in each of said subfields, executed are:

a pixel data writing step of forming pixel data indicative of either a light emitting cell or a non-light emitting cell with respect to each of the discharge cells of said plasma display panel in correspondence to said video signal, sequentially applying scanning pulses to one of each of said row electrode pairs, and applying pixel data pulses corresponding to said pixel data to said column electrodes synchronously with said scanning pulses, thereby setting each of said discharge cells into a state of either the light emitting cell or the non-light emitting cell corresponding to said pixel data; and a light emission sustaining step of alternately applying sustaining pulses to said plurality of row electrode pairs a number of times corresponding to a weight of each of said subfields so as to allow only the discharge cells which have been set into the state of the light emitting cell in said pixel data writing step to effect a sustain-discharge, and a sustaining pulse which is applied lastly among said sustaining pulses applied in said light emission sustaining step has a trailing edge portion undershooted below a ground potential.

36. A driving method for driving a plasma display panel in accordance with a video signal, said plasma display panel having a plurality of row electrode pairs having a capacitive load between the pairs and a plurality of column electrodes which are arranged so as to cross said row electrode pairs and form a discharge cell in each intersecting portion, wherein a display period of one field in said video signal is made up of a plurality of subfields, and in each of said subfields, executed are:

a pixel data writing step of forming pixel data indicative of either a light emitting cell or a non-light emitting cell with respect to each of the discharge cells of said plasma display panel in correspondence to said video signal, sequentially applying scanning pulses to one of each of said row electrode pairs, and applying pixel data pulses corresponding to said pixel data to said column electrodes synchronously with said scanning pulses, thereby setting each of said discharge cells into a state of either the light emitting cell or the non-light emitting cell corresponding to said pixel data;

a light emission sustaining step of alternately applying sustaining pulses to said plurality of row electrode pairs a number of times corresponding to a weight of each of said subfields so as to allow only the discharge cells which have been set into the state of the light emitting cell in said pixel data writing step to cause a sustain-discharge; and a resetting step of applying reset pulses to all of the row electrodes of said plurality of row electrode pairs prior to said pixel data writing step in at least one of said plurality of subfields, allowing each of all of the discharge cells of said plasma display panel to cause a reset-discharge, and initializing all of the discharge cells, and wherein a reset pulse applied lastly among said reset pulses applied in said resetting step has a trailing edge portion undershooted below a ground potential.

* * * * *